US008172586B2

(12) United States Patent
Tsai

(10) Patent No.: US 8,172,586 B2
(45) Date of Patent: May 8, 2012

(54) MULTILAYER ELECTRONIC CARD CONNECTOR WITH EJECTOR

(76) Inventor: Horng Yu Tsai, SinJhuang (TW)

( * ) Notice: Subject to any disclaimer, the term of this patent is extended or adjusted under 35 U.S.C. 154(b) by 16 days.

(21) Appl. No.: 12/904,868

(22) Filed: Oct. 14, 2010

(65) Prior Publication Data

US 2011/0086530 A1 Apr. 14, 2011

(30) Foreign Application Priority Data

Oct. 14, 2009 (TW) ..... 98218993 U
Feb. 9, 2010 (TW) ..... 99202748 U

(51) Int. Cl.
*H01R 13/62* (2006.01)

(52) U.S. Cl. ..... 439/159; 439/630

(58) Field of Classification Search ..... 439/64, 439/152, 159, 160, 630, 631, 637
See application file for complete search history.

(56) References Cited

U.S. PATENT DOCUMENTS 6,287,143 B1 * 9/2001 Lwee ..... 439/541.5
6,520,783 B2 * 2/2003 Hsu ..... 439/157
6,739,890 B2 * 5/2004 Hirata et al. ..... 439/159
6,814,597 B1 * 11/2004 Kao ..... 439/159
7,341,466 B1 * 3/2008 Kondo ..... 439/159
7,448,889 B1 * 11/2008 Ho et al. ..... 439/159
7,537,470 B2 * 5/2009 Yamaguchi ..... 439/159
7,927,117 B2 * 4/2011 Yu et al. ..... 439/159

* cited by examiner

*Primary Examiner* — Thanh Tam Le

(74) *Attorney, Agent, or Firm* — Pro-Techtor Int'l Services

(57) ABSTRACT

An electronic card connector includes a base, upper and lower terminals and an ejector including a core, a sliding sheet, a guiding rod and an elastic member. A baffle separates the base into upper and lower slots for respectively accommodating upper and lower cards. The core has a sliding slot, which has one end having a concave positioning point, and the other end having a starting point, such that unidirectional circulation successively from the starting point to the positioning point and then to the starting point is formed. The sheet may slide relatively to the base and has first and second pushing portions respectively disposed in the lower and upper slots. The rod has one end engaged into the sliding slot and is slidable along the sliding slot. The elastic member provides elasticity for moving the sliding sheet into the base and then returning the sheet to a home position.

19 Claims, 22 Drawing Sheets

80
70
77
65
613
610
69
62
61
67
75
612
63
68
76

80
67
70
65
66
62
69
68
61
71
77
72
75
76
64
611
63
611
610
612
611
6
38
36
313
34
31
316
42
43
46
38
47
44
45

30
31
32
33
325
33
311
310
311
50
56
55
51
312
39
32
312
36
41
35
37
40

MULTILAYER ELECTRONIC CARD CONNECTOR WITH EJECTOR

BACKGROUND OF THE INVENTION

1. Field of the Invention

The invention relates in general to an electrical connector, and more particularly to a multilayer electronic card connector with an ejector.

2. Related Art

Electrical cards for computers include a multimedia storage card and a memory card. At present, the memory cards available in the market have many specifications and may be classified into a Secure Digital Card (hereinafter referred to as SDC), a MutiMedia Card (hereinafter referred to as MMC), an XD-Picture Card (hereinafter referred to as XDC), a Memory Stick Card (hereinafter referred to as MSC), and a Compact Flash Card (hereinafter referred to as CFC), and the like. Because the connection points of the memory cards with different specifications have different positions, the electrical connectors for different specifications of memory cards are different from one another.

In order to achieve the convenience in use, the manufacturers have done their best to integrate various types of electrical connectors into one integrated connector, which can access various specifications of memory cards.

In addition, another electrical connector may have two slots. Because it is difficult to dispose terminals in the upper slot, the upper slot is only suitable for one memory card. Furthermore, no ejector is disposed in the connector with two slots.

As shown in FIG. 1, a small card for MSC has been developed and named as Memory Stick Duo Card (hereinafter referred to as MS-Dou C). One end of MSC 10 and one end of MS-Dou C 15 respectively have connection points 11 and 16 arranged in the same manner. The MSC 10 is thicker and wider than the MS-Dou C 15. In addition, a small card for SDC also has been developed and referred to as mini-SDC, as shown in FIG. 1. The mini-SDC 18 has the width substantially equal to that of the MS-Dou C 15, and the length shorter than that of the MS-Dou C 15. One side of the mini-SDC 18 has a notch 19, but one side of the MS-Dou C 15 has no notch.

Furthermore, a Memory Stick Pro HG Card (hereinafter referred to as MSHG C) having the transmission speed higher than that of the MSC has been developed, wherein the MSHG C has one more row of four connection points than the MSC.

SUMMARY OF THE INVENTION

It is therefore a main object of the invention to provide a multilayer electronic card connector with an ejector so that the upper and lower slots have the main functions of guiding the cards in and ejecting the cards.

Another object of the invention is to provide a multilayer electronic card connector with an ejector, wherein electrical cards with different interfaces or different shapes may be inserted into the upper and lower slots for connections.

Still another object of the invention is to provide a multilayer electronic card connector, which has an ejector and can stop an electrical card to prevent the card from being incorrectly inserted.

Yet still another object of the invention is to provide a multilayer electronic card connector with an ejector, wherein only one electrical card can be inserted into and electrically connected to one of the upper and lower slots, and two electrical cards cannot be inserted into and electrically connected to the upper and lower slots.

To achieve the above-identified objects, the invention provides a multilayer electronic card connector. The connector includes a base, at least one row of upper terminals disposed in the base, at least one row of lower terminals disposed in the base, an ejector disposed in the base. A baffle for separating the base into an upper slot and a lower slot is positioned in the base. The baffle defines a bottom surface of the upper slot and a top surface of the lower slot. The upper slot may accommodate at least one upper electrical card. The lower slot and may accommodate at least one lower electrical card. Each of the upper terminals has a contact disposed in the upper slot. Each of the lower terminals has a contact disposed in the lower slot. The ejector includes a core, a sliding sheet, a guiding rod and an elastic member. The core has a sliding slot defining a circulation path. One end of the sliding slot has a concave positioning point, and the other end of the sliding slot has a starting point, such that unidirectional circulation successively from the starting point to the positioning point and then to the starting point is formed. The sliding sheet may slide back and forth relatively to the base. The sliding sheet has a first pushing portion and a second pushing portion. The first pushing portion is disposed in the lower slot, and the second pushing portion is disposed in the upper slot. The guiding rod has one end engaged into the sliding slot of the core and is slidable along the circulation path. The elastic member provides elasticity for moving the sliding sheet into the base and then returning the sliding sheet to a home position. When the lower electrical card is inserted into the lower slot, the lower electrical card can rest against the first pushing portion to push the sliding sheet to slide relatively to the base. When the upper electrical card is inserted into the upper slot, the upper electrical card can rest against the second pushing portion to push the sliding sheet to slide relatively to the base.

Furthermore, there may be multiple rows of upper terminals, and the upper slot may accommodate multiple electrical cards with different interfaces or different shapes. There may be multiple rows of lower terminals, and the lower slot may accommodate multiple electrical cards with different interfaces or different shapes.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE INVENTION

Figure 1:
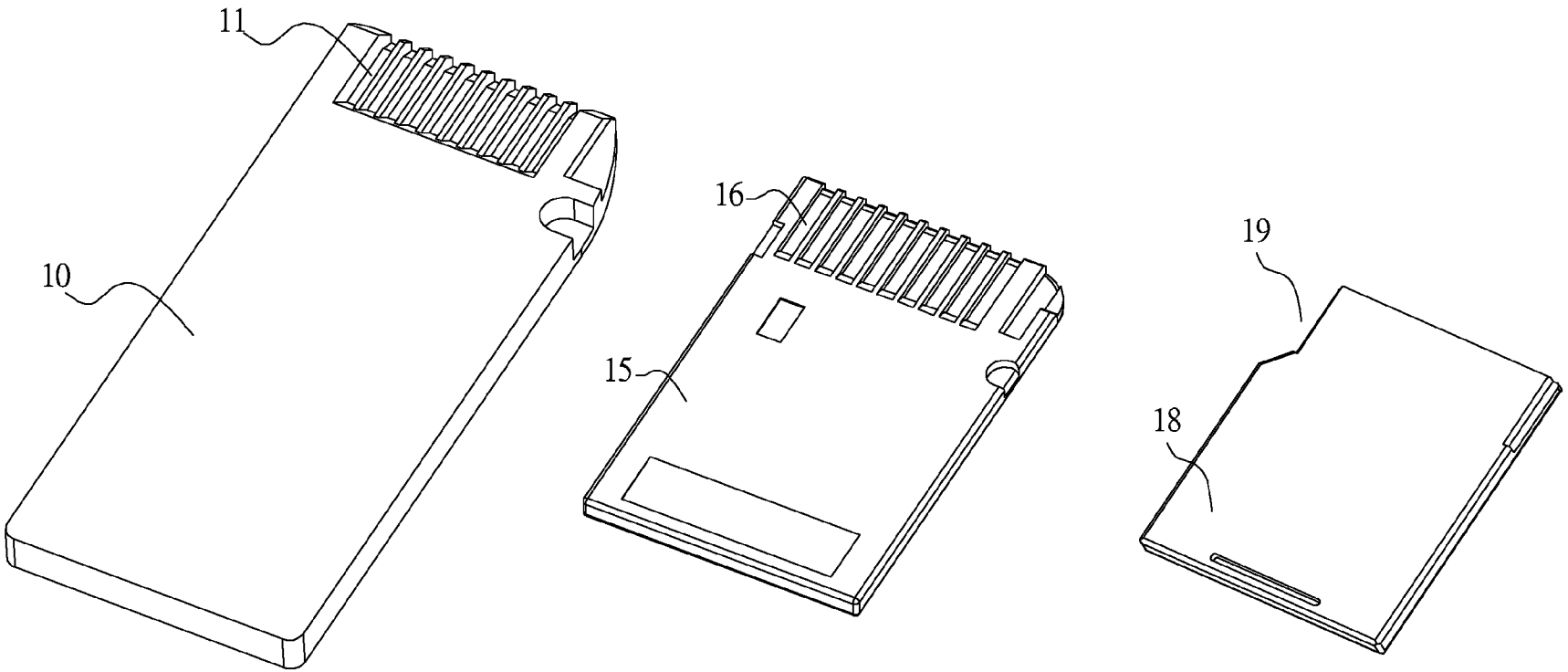
FIG. 1 (Prior Art)
FIG. 1 is a pictorial view showing three conventional memory cards.
Figures 2, 3:
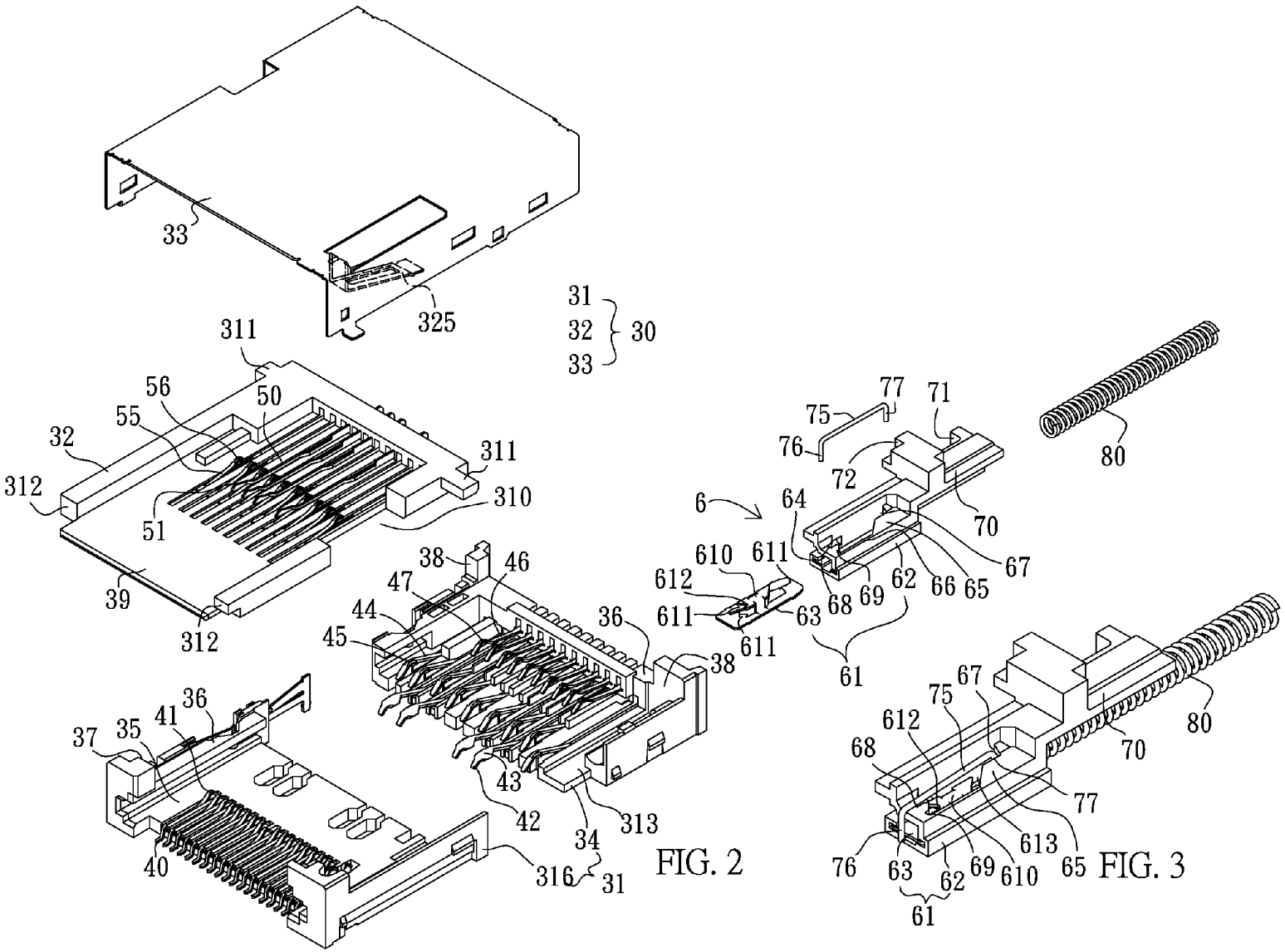
FIG. 2 is a pictorially exploded view showing a first embodiment of the invention.
FIG. 3 is a pictorially assembled view showing an ejector according to the first embodiment of the invention.
Figure 4:
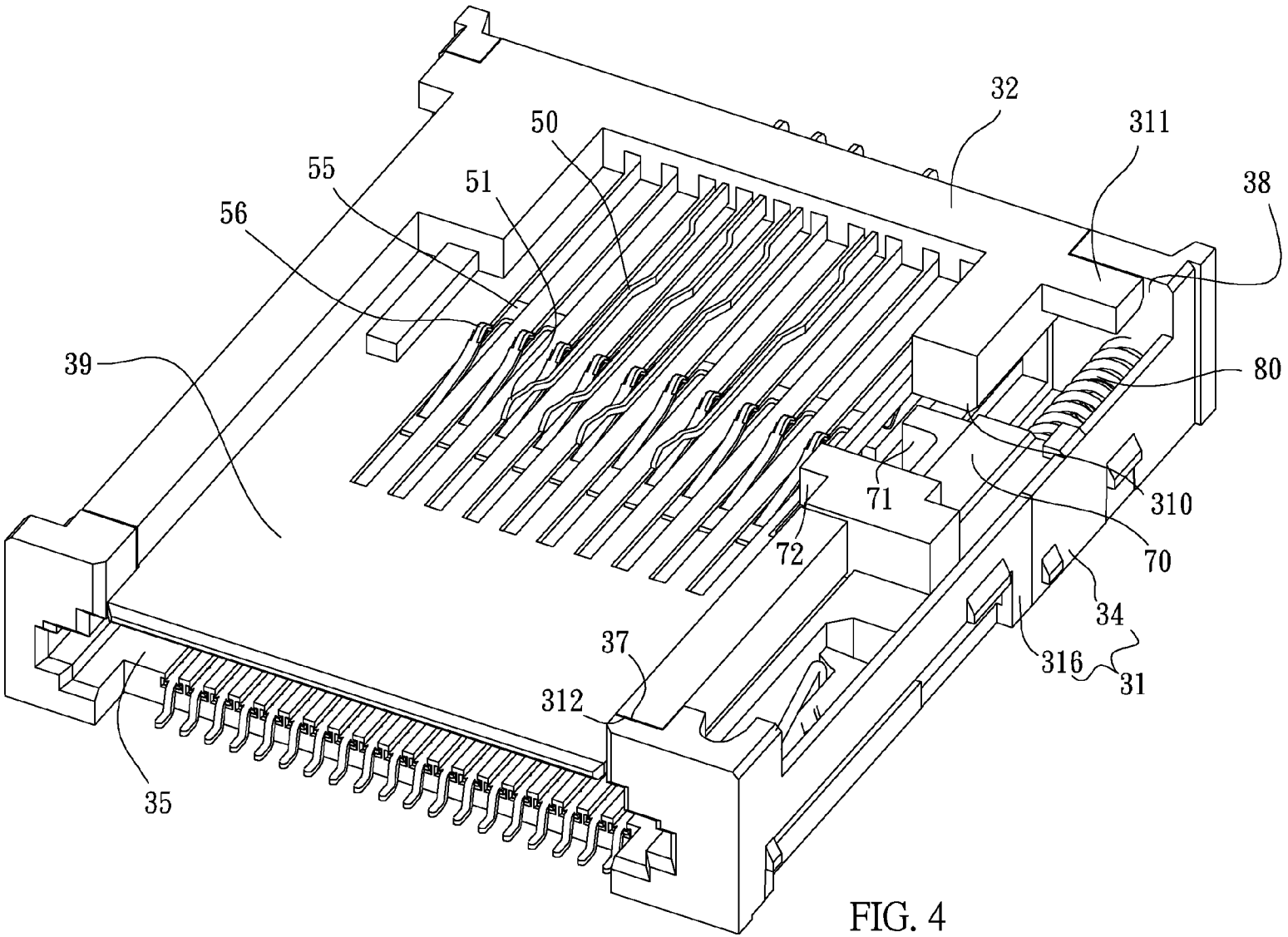
FIG. 4 is a pictorially assembled view showing the first embodiment of the invention without the metal upper cover.
Figure 5:
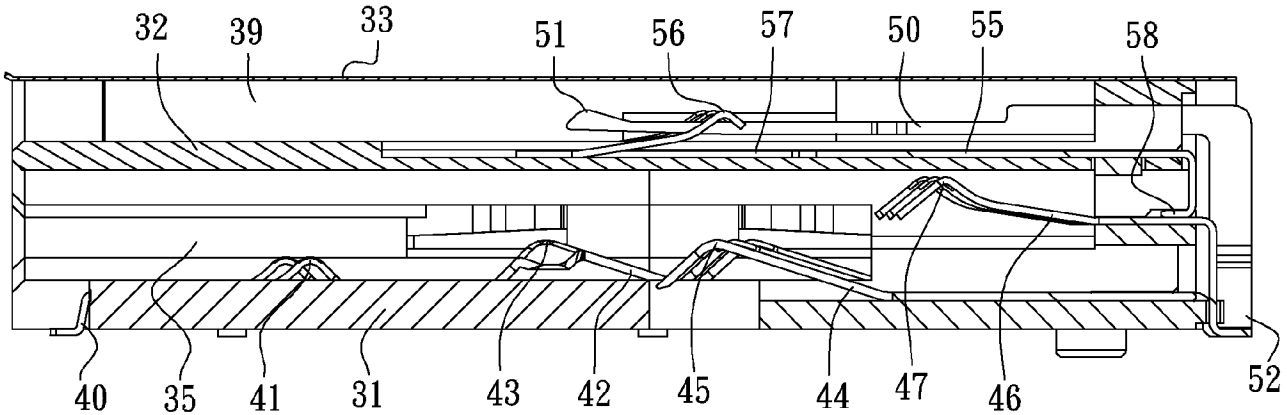
FIG. 5 is a cross-sectional side view showing the first embodiment of the invention.
Figure 6:
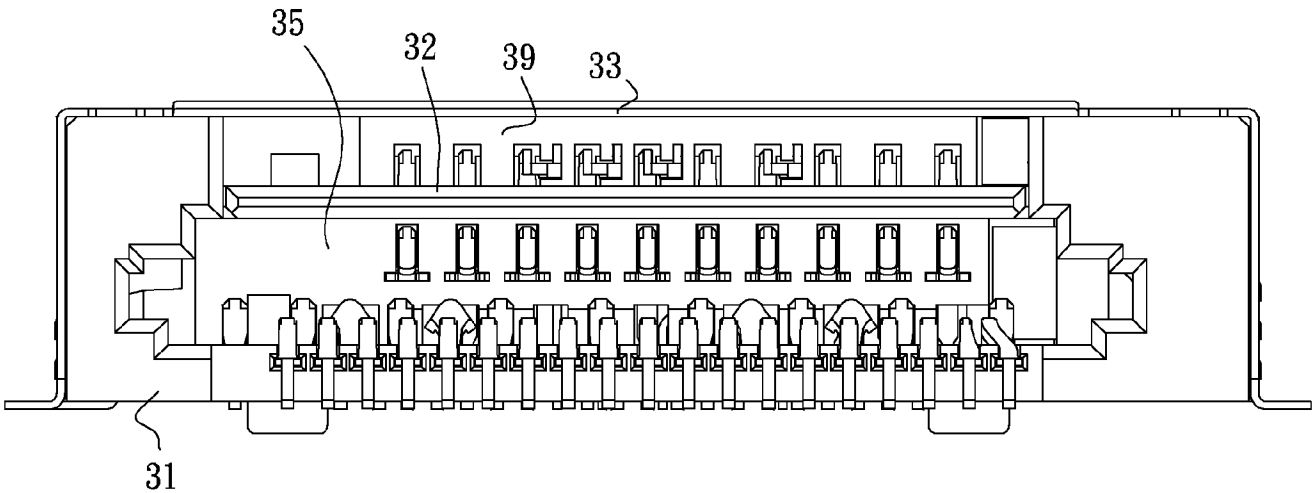
FIG. 6 is a front view showing the first embodiment of the invention.

The present invention will be apparent from the following detailed description, which proceeds with reference to the accompanying drawings, wherein the same references relate to the same elements.

Referring to FIGS. 2 to 6, the first embodiment of the invention is a memory card connector to be shared by seven cards. The card connector includes a base 30, one row of first lower terminals 40, one row of second lower terminals 42, one row of third lower terminals 44, one row of fourth lower terminals 46, one row of first upper terminals 55, one row of second upper terminals 50 and an ejector 6.

The base 30 has a plastic base 31, a baffle 32 and a metal upper cover 33. The metal upper cover 33 has two lateral sides and a top surface, and covers over and engages with the plastic base 31. The baffle 32 engages with the plastic base 31 to separate the base into an upper slot 39 and a lower slot 35. The baffle 32 defines a bottom surface of the upper slot 39 and a top surface of the lower slot 35. The plastic base 31 is composed of a front seat 316 and a rear seat 34 and is formed with the lower slot 35. The lower slot 35 may accommodate multiple electrical cards with different interfaces or different shapes. The plastic base 31 has a connection plane 36. The front seat 316 has a front resting surface 37. The rear seat 34 has a rear resting surface 38. In addition, one side of the plastic base 31 is formed with a sliding slot 313. The baffle 32 is a base formed by way of plastic injection molding. The baffle 32 is formed with the upper slot 39. The upper slot 39 may accommodate multiple electrical cards with different interfaces or different shapes. One side of the baffle 32 is formed with a notch 310, and two projections 311 are respectively formed on two sides near the rear end. In addition, two sides of the front end thereof are formed with two resting surfaces 312. The baffle 32 is disposed on the connection plane 36 of the plastic base 31. The projections 311 on two sides of the rear end thereof are connected to the rear resting surface 38 of the plastic base, and the resting surfaces 312 on two sides of the front end thereof rest against the front resting surface 37 of the plastic base.

The one row of first lower terminals 40 are disposed on the front seat 316 of the plastic base, and each first lower terminal 40 has a contact 41 disposed in the lower slot 35.

The one row of second lower terminals 42 contain four terminals disposed on the rear seat 34 of the plastic base. Each second lower terminal 42 has a contact 43 disposed in the lower slot 35 and in back of the contact 41.

The one row of third lower terminals 44 contain nine terminals disposed on the rear seat 34 of the plastic base. Each third lower terminal 44 has a contact 45 disposed in the lower slot 35 and in back of the contact 43.

The one row of fourth lower terminals 46 contain ten terminals disposed on the rear seat 34 of the plastic base. Each fourth lower terminal 46 has a contact 47 disposed in the lower slot 35 and in back of the contact 45.

The one row of first upper terminals 55 contain ten terminals disposed on the baffle 32. Each first upper terminal 55 has a contact 56, an extension 57 and a bridge portion 58. The extension 57 is in surface contact with the baffle 32. The contact 56 is bent reversely from the front end of the extension 57, projects upwardly and is disposed in the upper slot 39. The bridge portion 58 is connected to the extension 57. The bridge portion 58 of each first upper terminal 55 is connected to a fourth lower terminal 46.

The one row of second upper terminals 50 contain four terminals disposed on the baffle 32. Each second upper terminal 50 is formed by pressing a plate sheet and has a longitudinal plate surface. The second upper terminal 50 has a contact 51 disposed in the upper slot 39 and a pin portion 52 extending to the bottom in back of the base. The one row of second upper terminals 50 become longitudinal through the plate surface, so that the space can be saved and the terminals 50 can be easily disposed.

The ejector 6 is disposed in the sliding slot 313 on one side of the plastic base 31, and includes a core 61, a sliding sheet 70, a guiding rod 75 and a spring 80.

The core 61 is disposed in the sliding slot 313 of the plastic base 31, and has a core base 62 and a metal baseplate 63. The core base 62 and the sliding sheet 70 are integrally formed by way of plastic injection molding. The core base 62 has an outer track plate 65 and a slot 64. The outer track plate 65 has an opening 66 and is disposed above the slot 64. One end of the opening 66 is a tip end being a starting point 67, while the other end of the opening 66 is an M-like shape forming a middle convex portion and two concave portions. The two concave portions respectively define a stoke point 68 and an ejection starting point 69. The middle of the metal baseplate 63 projects in the direction toward the plate surface to form an inner track plate 610, and the periphery is formed with three one-way stopper blocks 611 higher than the plate surface. The metal baseplate 63 engages with the slot 64 of the core base 62. The inner track plate 610 is disposed in the opening 66. A sliding slot 613 defining a circulation path is formed between the inner and outer track plates. One end of the inner track plate 610 corresponding to the one M-shaped end of the outer track plate 65 also has an M-like shape to form a concave positioning point 612. The other end of the inner track plate 610 is a tip end corresponding to the starting point 67. With the three one-way stopper blocks 611, the sliding slot 613 has the unidirectional circulation successively from the starting point 67 to the stoke point 68, to the positioning point 612, to the ejection starting point 69 and to the starting point 67.

The sliding sheet 70 and the core base 62 of the core 61 are integrally formed by way of plastic injection molding. The sliding sheet 70 has a first pushing portion 71 and a second pushing portion 72 disposed at different levels. The first and second pushing portions 71, 72 project into the base 30. The first pushing portion 71, disposed on one side of the lower slot 35, may be pushed by a lower memory card inserted into the lower slot 35. The second pushing portion 72, extending from the notch 310 into one side of the upper slot 39, can be pushed by an upper memory card inserted into the upper slot 39.

The guiding rod 75 having an inverse-U shape has one end 76 for hooking and positioning the plastic base 31, and the other end 77 fit with the sliding slot 613 of the core 61. When the sliding sheet 70 is pushed by the memory card, the core 61 is moved so that the end 77 of the guiding rod 75 slides in the sliding slot 613. When the end 77 of the guiding rod 75 is positioned at the positioning point 612, the memory card is in the insert-connection state. When the end 77 of the guiding rod 75 moves back to the starting point 67, the memory card is in the ejecting state.

The metal upper cover 33 has an elastic pressing sheet 325 for downwardly pressing and elastically pressing against the guiding rod 75.

The spring 80 is disposed in the sliding slot 313 of the base 30, and has one end fit with the post 36, and the other end resting against the sliding sheet 70. The spring 80 provides the elasticity for moving the sliding sheet 70 into the base and then returning the sliding sheet 70 to the home position.

With the above-mentioned structure, the baffle 32 has one row of first upper terminals 55 and one row of second upper terminals 50. The upper slot may receive the inserted MSHG C and MS-Dou C. When the MSHG C is inserted, it is electrically connected to the two rows of upper terminals. When the MS-Dou C is inserted, it is only electrically connected to the one row of first upper terminals 55. When the MSHG C or MS-Dou C is inserted into the upper slot 39, it pushes the second pushing portion 72 of the sliding sheet 70 of the ejector 6 to make the sliding sheet 70 slide relatively to the base 30. At this time, the end 77 of the guiding rod 75 firstly slides to the stoke point 68, and then to the positioning point 612 according to the returning force of the spring 80. When the end 77 of the guiding rod 75 is positioned at the positioning point 612, the memory card is in the insert-connection state. When the card is to be ejected, the memory card is pushed. At this time, the end 77 of the guiding rod 75 firstly slides to the ejection starting point 69, and then to the starting point 67 according to the returning force of the spring 80. When the end 77 of the guiding rod 75 moves back to the starting point 67, the memory card is in the ejecting state. In this manner, the card can be inserted and ejected.

The plastic base 31 has one row of first lower terminals 40, one row of second lower terminals 42, one row of third lower terminals 44 and one row of fourth lower terminals 46. So, five memory cards including SDC, XDC, MSC, MMC and MMC-plus can be inserted into and electrically connected to the lower slot 35, wherein XDC is electrically connected to the one row of first lower terminals 40, SDC and MMC are electrically connected to the one row of third lower terminals 44, MMC-plus is electrically connected to the one row of second lower terminals 42 and the one row of third lower terminals 44, and MSC is electrically connected to the one row of fourth lower terminals 46. When one of the memory cards is inserted into lower slot 35, it pushes the first pushing portion 71 of the sliding sheet 70 of the ejector 6 to make the sliding sheet 70 slide relatively to the base 30. When the end 77 of the guiding rod 75 is positioned at the positioning point 612, the memory card is in the insert-connection state. When the end 77 of the guiding rod 75 moves back to the starting point 67, the memory card is in the ejecting state.

Figure 8:
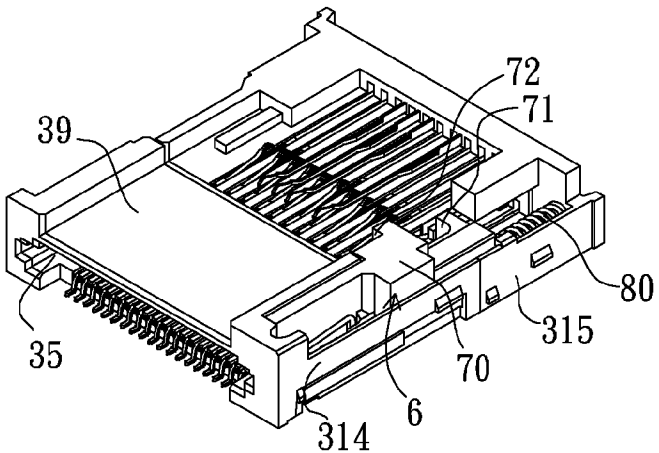
FIG. 8 is a pictorially assembled view showing the second embodiment of the invention without the metal upper cover.
Figure 7:
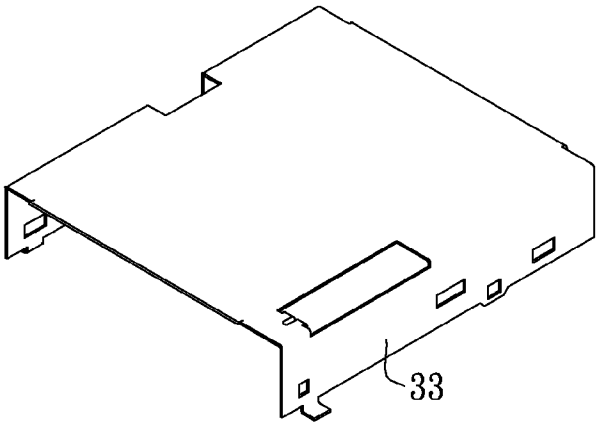
FIG. 7 is a pictorially exploded view showing a second embodiment of the invention.
Figure 7:
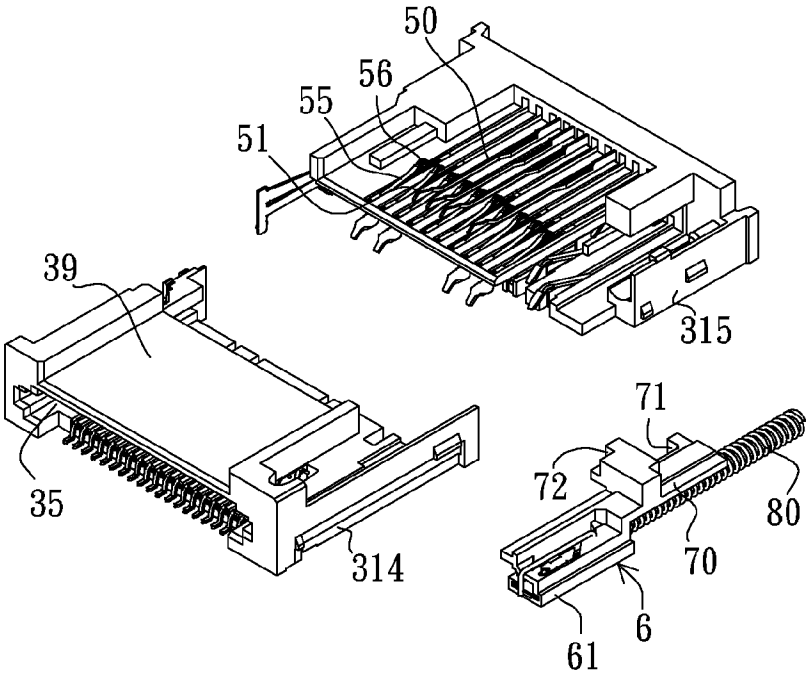

As shown in FIGS. 7 and 8, the second embodiment of the invention is almost the same as the first embodiment except that the plastic base of the base 30 and the baffle are integrally formed and the plastic base has a front seat 314 and a rear seat 315.

Figure 9:
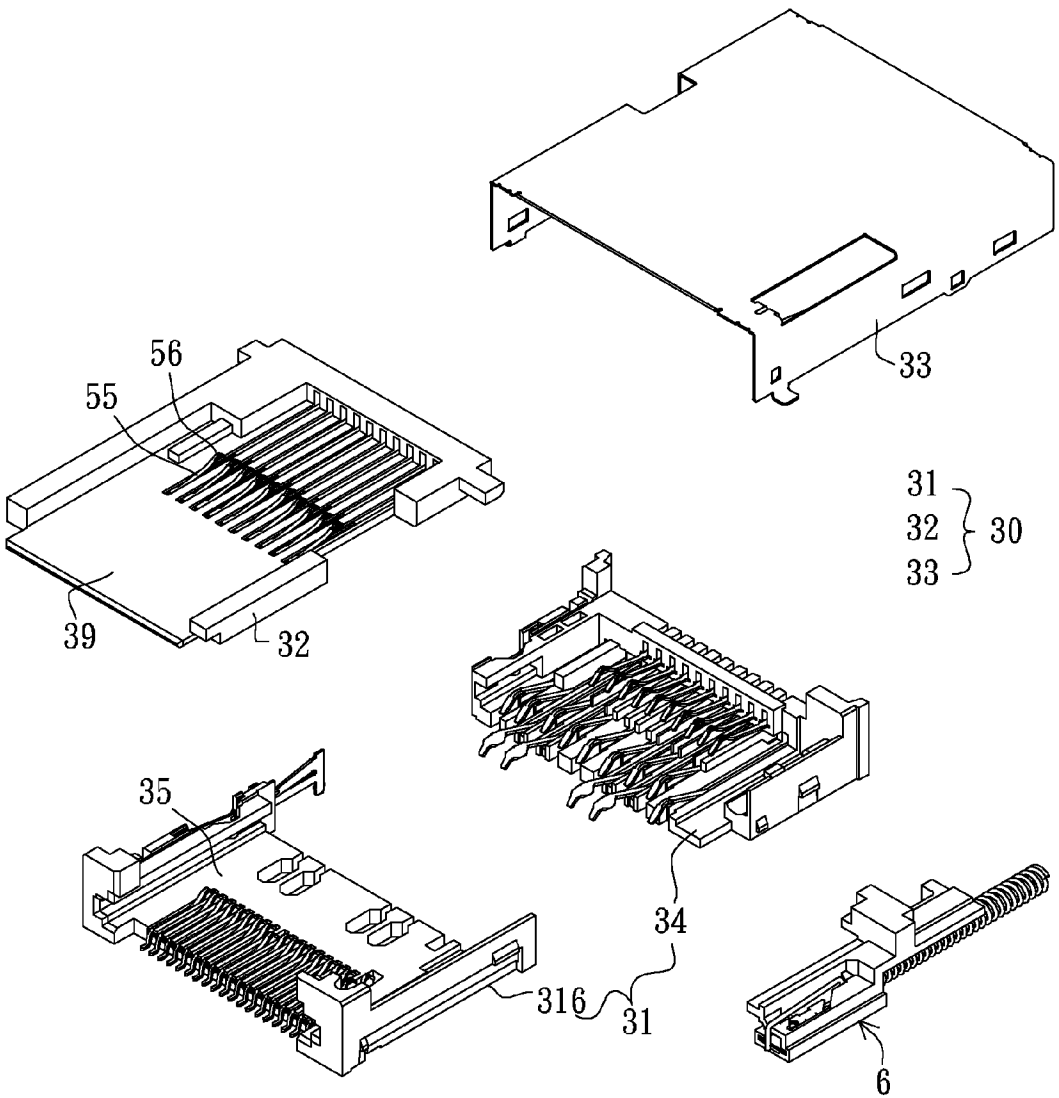
FIG. 9 is a pictorially exploded view showing a third embodiment of the invention.

As shown in FIG. 9, the third embodiment of the invention is a connector, which may be shared by six memory cards, and is almost the same as the first embodiment except that the baffle 32 only has one row of first upper terminals 55. The upper slot 39 only can be electrically connected to the inserted MS-Dou C, while the lower slot 35 can be electrically connected to five different memory cards being inserted.

Figure 10:
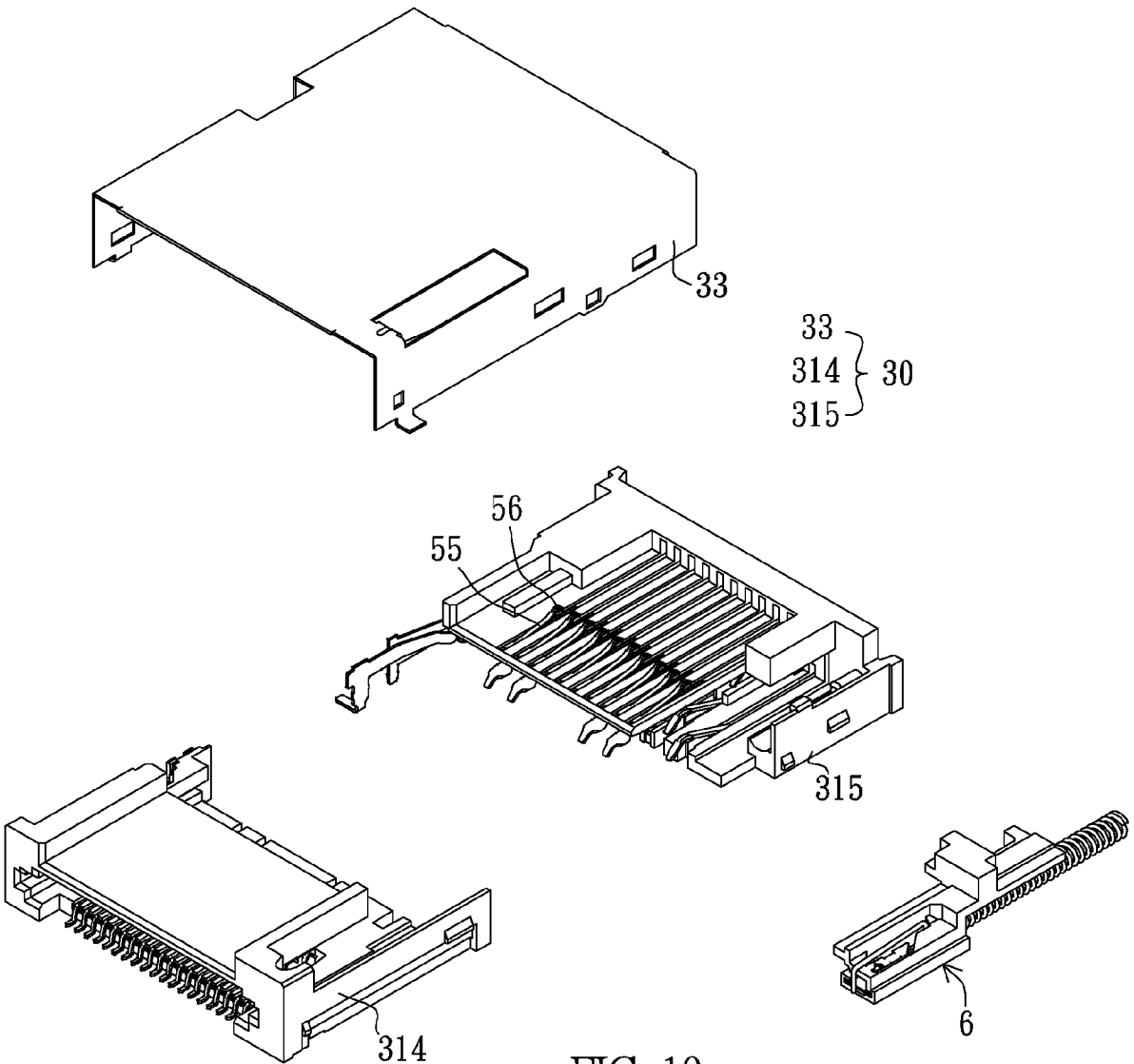
FIG. 10 is a pictorially exploded view showing a fourth embodiment of the invention.

As shown in FIG. 10, the fourth embodiment of the invention is a connector, which may be shared by six memory cards, and is almost the same as the second embodiment except that the baffle 32 only has one row of first upper terminals 55. The upper slot 39 only can be electrically connected to the inserted MS-Dou C, while the lower slot 35 can be electrically connected to five different memory cards being inserted.

Figures 11, 12:
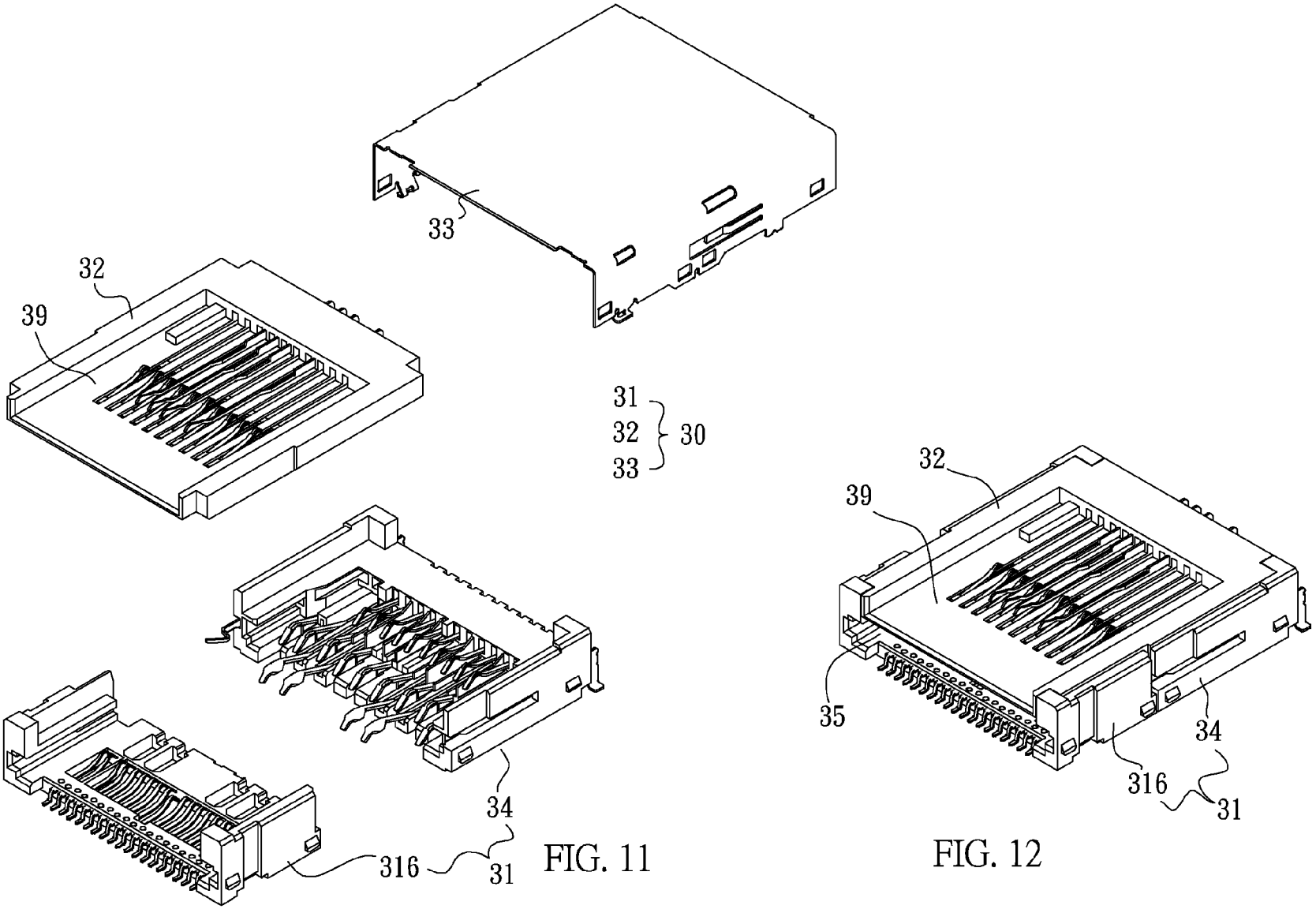
FIG. 11 is a pictorially exploded view showing a fifth embodiment of the invention.
FIG. 12 is a pictorially assembled view showing the fifth embodiment of the invention without the metal upper cover.

As shown in FIGS. 11 and 12, the fifth embodiment of the invention is almost the same as the first embodiment and is similarly a connector, which can be shared by seven memory cards. The plastic base 31 divides the base into the front seat 316 and the rear seat 34. The only one difference resides in that this embodiment has no ejector.

Figure 14:
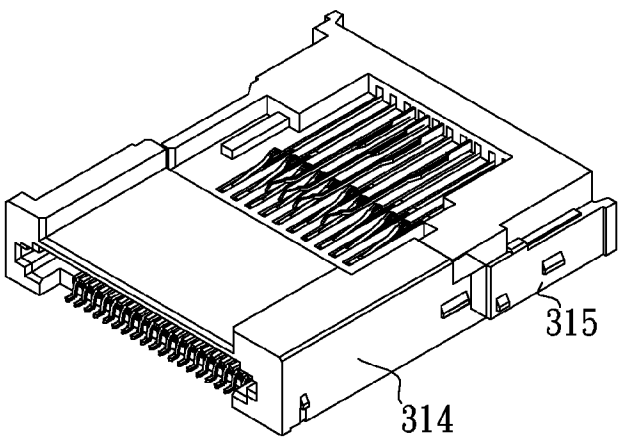
FIG. 14 is a pictorially assembled view showing the sixth embodiment of the invention without the metal upper cover.
Figure 13:
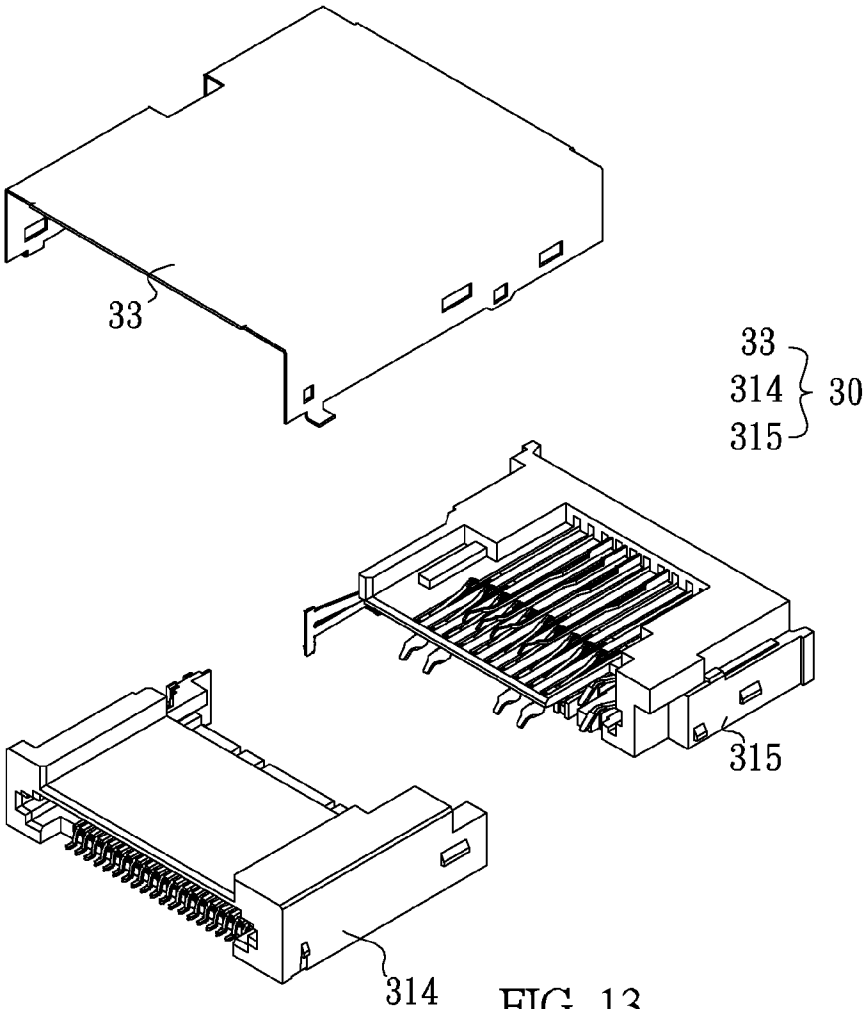
FIG. 13 is a pictorially exploded view showing a sixth embodiment of the invention.

As shown in FIGS. 13 and 14, the sixth embodiment of the invention is almost the same as the second embodiment and is similarly a connector, which can be shared by seven memory cards. Similarly, the plastic base of the base 30 and the baffle are integrally formed and the plastic base has a front seat 314 and a rear seat 315. The only one difference resides in that this embodiment has no ejector.

Figure 15:
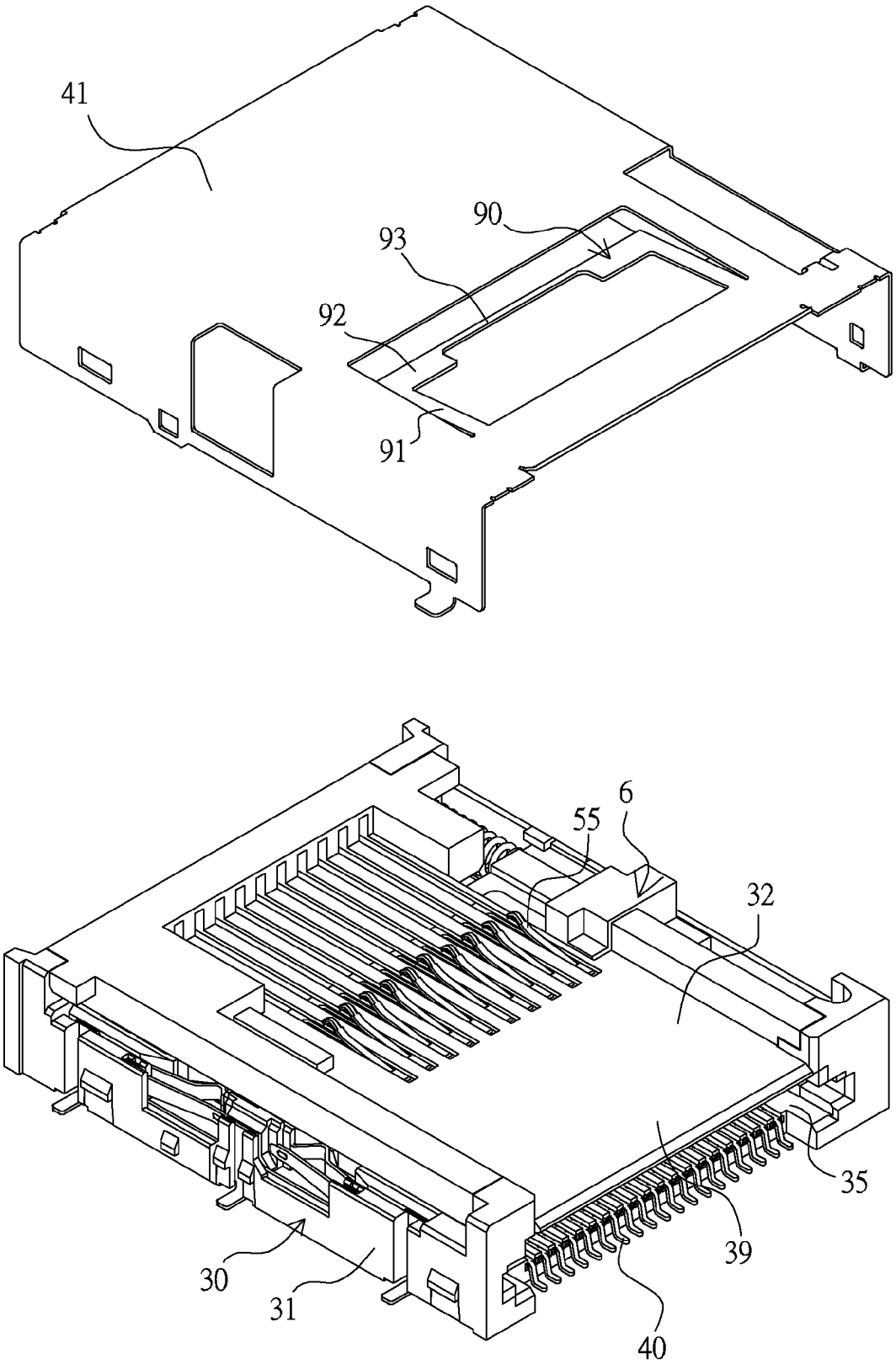
FIG. 15 is a pictorially exploded view showing a seventh embodiment of the invention.
Figure 16:
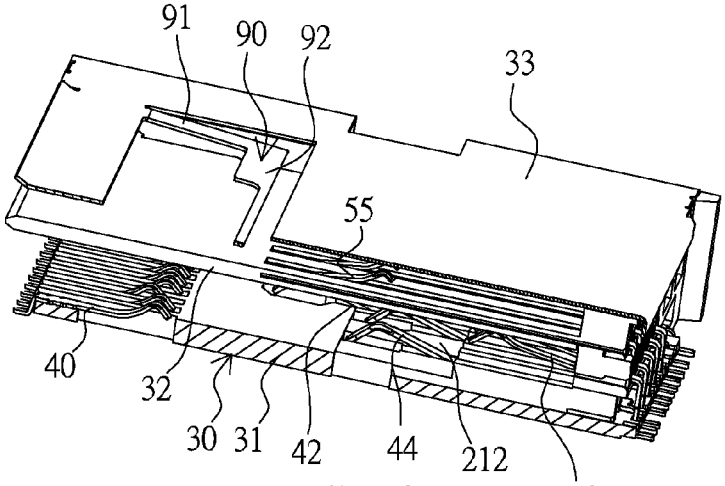
FIG. 16 is a pictorially assembled view showing the seventh embodiment of the invention.

As shown in FIGS. 15 and 16, the seventh embodiment of the invention is a connector, which can be shared by six memory cards, and is almost the same as the third embodiment because one base 30 and an ejector 6 are provided. The difference resides in that the base 30 of this embodiment further has a stopper structure 90. The stopper structure 90 projects downwardly from the metal upper cover 33, and has two elastic arms 91 and two stopper sheets 92. The two elastic arms 91 are disposed on two sides of the upper slot 39. One end of the elastic arm 91 is connected to the metal upper cover 33 and extends downwardly and slantingly from front to rear. The two stopper sheets 92 are connected to the rear ends of the two elastic arms 91 and extend transversally inwards. The two stopper sheets 92 are connected together through a transversal strip 93 so that the stopper structure 90 has an inverse-U shape.

Figure 17:
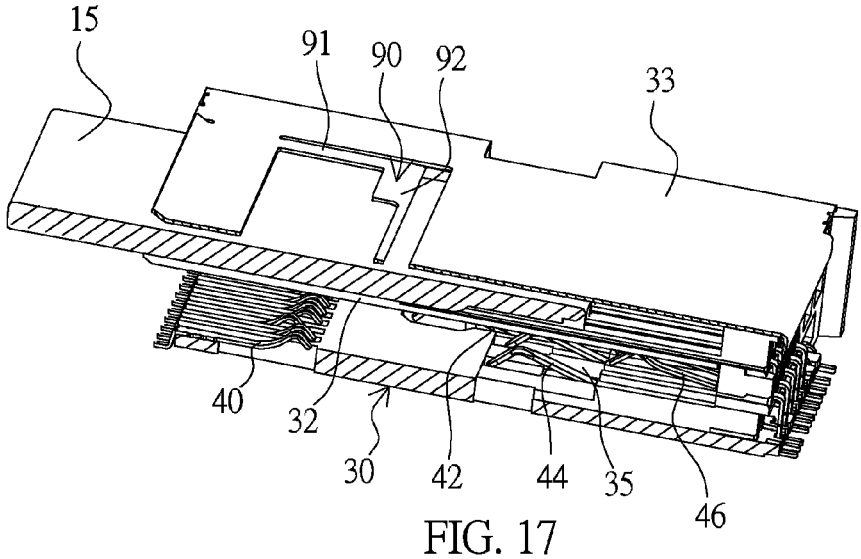
FIGS. 17 and 18 show the usage states of the seventh embodiment of the invention.

As shown in FIG. 17, when the MS-Dou C 15 is inserted from the upper slot 39, the width of the MS-Dou C 15 makes the MS-Dou C 15 to rest against the two elastic arms 91 of the stopper structure 90. So, the stopper structure 90 may be pushed up by the MS-Dou C 15, and the MS-Dou C 15 can be inserted and electrically connected to the first upper terminal 55.

Figure 18:
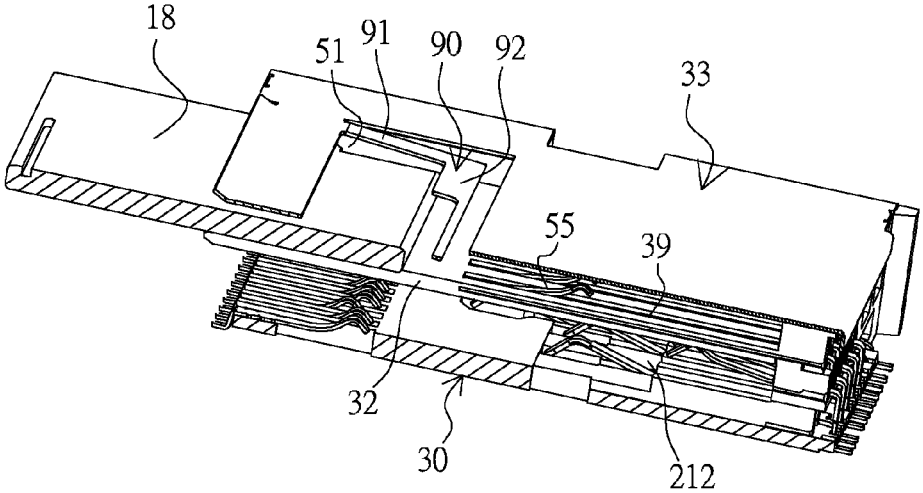

As shown in FIG. 18, because one side of its connection end is formed with a notch, if the user incorrectly insert the mini-SDC 18 from the upper slot 39, the side having the notch does not press the elastic arm 91 on one side of the stopper structure 90. When the mini-SDC 18 is further pushed in, it rests against the front edge of the stopper sheet 92, and cannot be inserted and then fall into the base. When the card falls into the base, it cannot be taken out easily.

Figure 19:
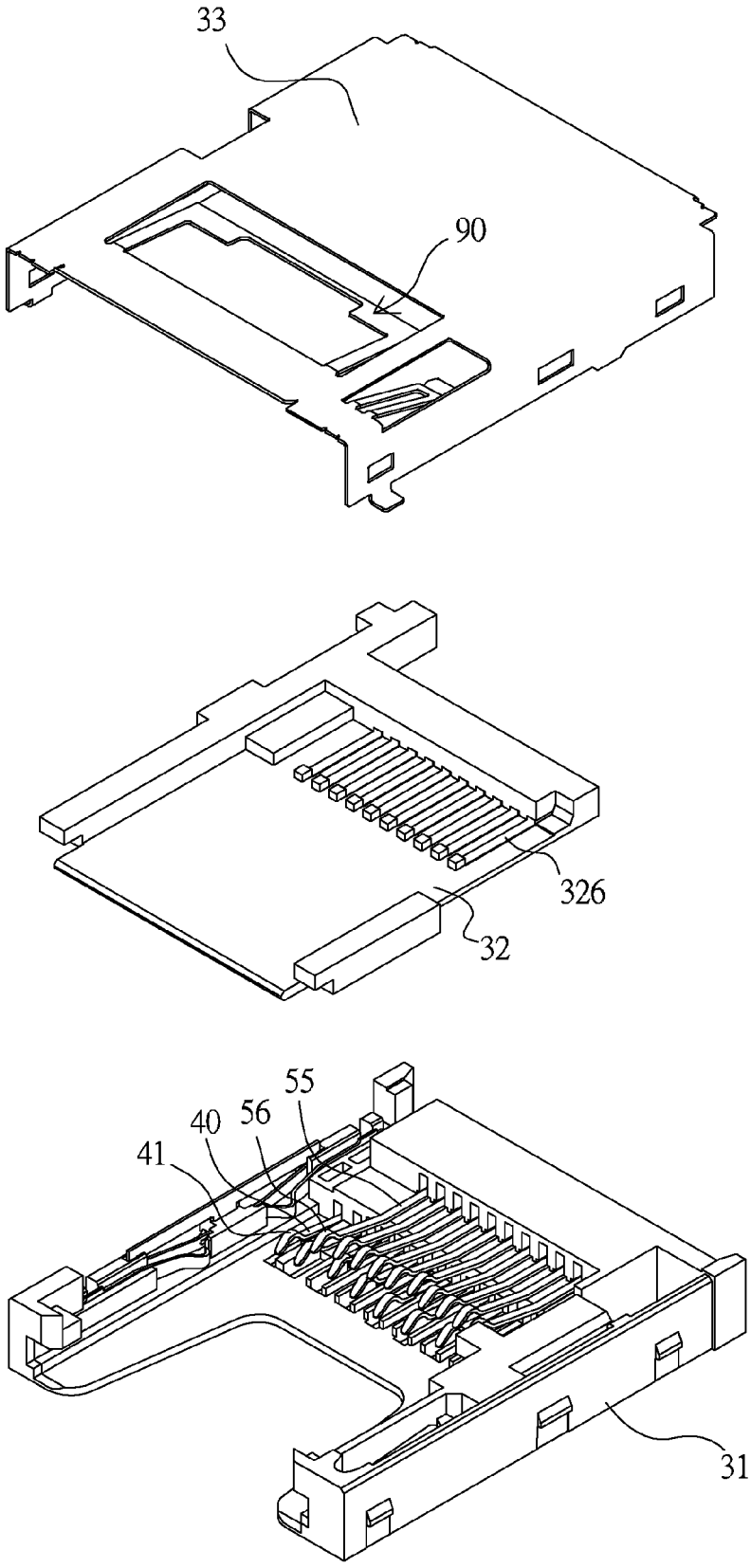
FIG. 19 is a pictorially exploded view showing an eighth embodiment of the invention.
Figure 20:
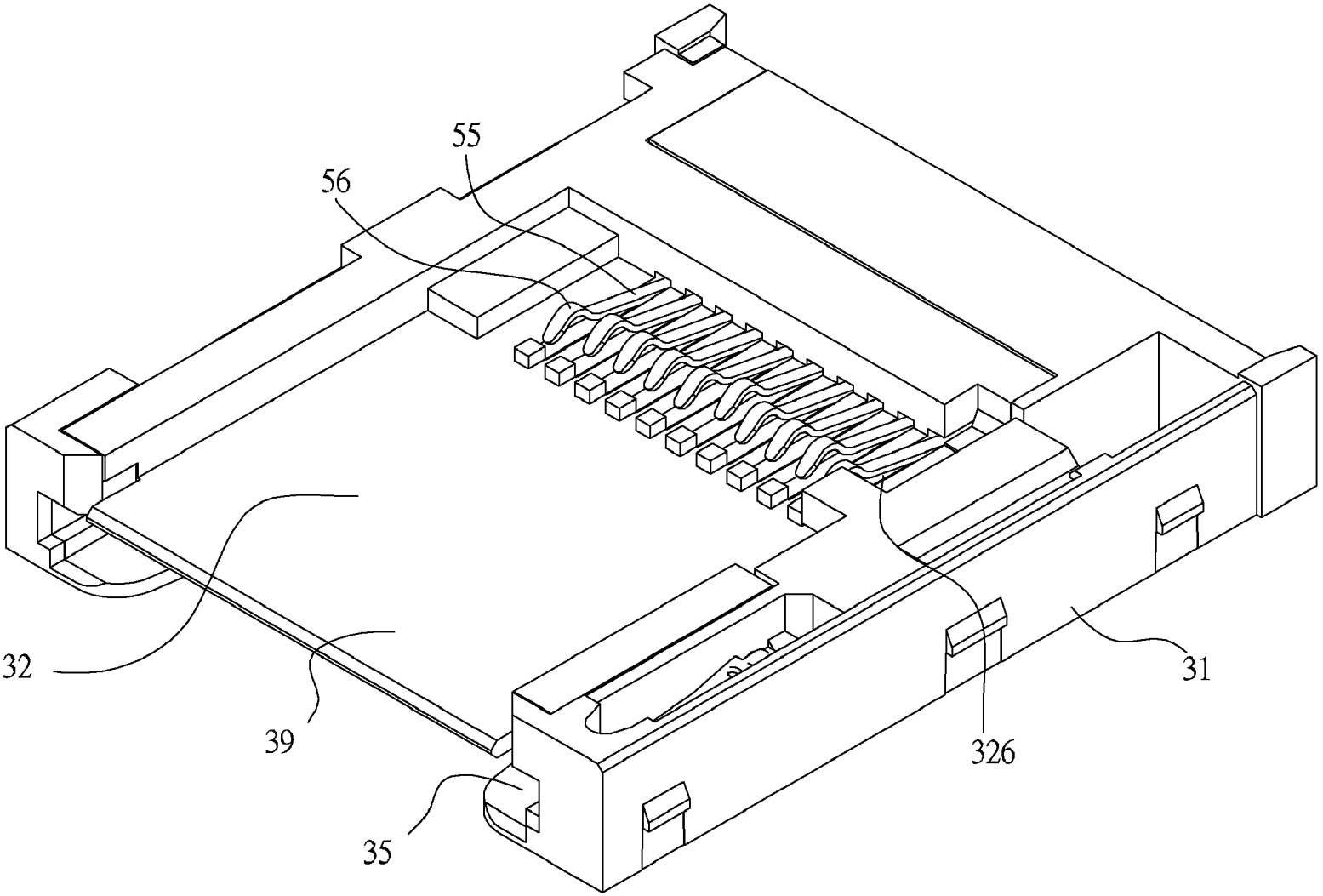
FIG. 20 is a pictorially assembled view showing the eighth embodiment of the invention without the upper cover.

As shown in FIGS. 19 and 20, the eighth embodiment of the invention is a connector, which can be shared by three memory cards, and is almost the same as the seventh embodiment. Similarly, one base 30 and an ejector 6 are provided. The difference resides in that the plastic base 31 has one row of first upper terminals 55 and one row of first lower terminals 40. The baffle 32 is formed with one row of through slots 326. The contact 56 of the first upper terminal 55 projects from the through slot 326 of the baffle 32 to the upper slot 39. The contact 41 of the first lower terminal 40 is disposed in the lower slot 35. The upper slot 39 may receive the inserted MS-Dou C, which is electrically connected to the first upper terminal 55. The lower slot 35 may receive the inserted SDC or MMC, which is electrically connected to the contact 41 of the first lower terminal 40.

Figure 21:
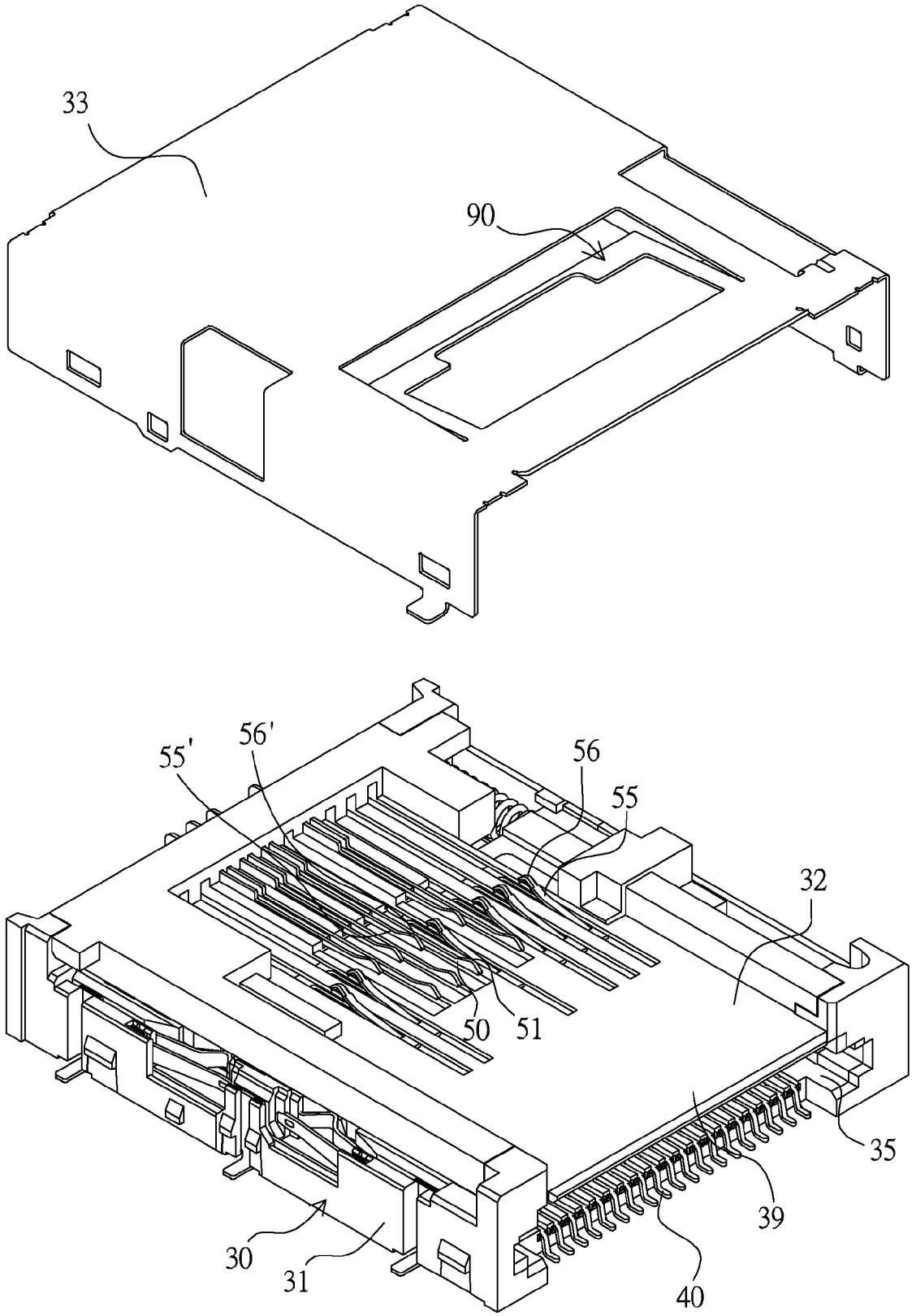
FIG. 21 is a pictorially exploded view showing a ninth embodiment of the invention.

As shown in FIG. 21, the ninth embodiment of the invention is a connector shared by seven memory cards, and is almost the same as the first embodiment except that the base 30 of this embodiment further has a stopper structure 90. The stopper structure 90 projects downwardly from the metal upper cover 33. The stopper structure 90 is the same as the seventh embodiment.

In order to facilitate the arrangement of the one row of ten first upper terminals 55 and the one row of four second upper terminals 50, the plate surfaces of the four second upper terminals 50 and four of the first upper terminals 55 are longitudinal.

Figure 22:
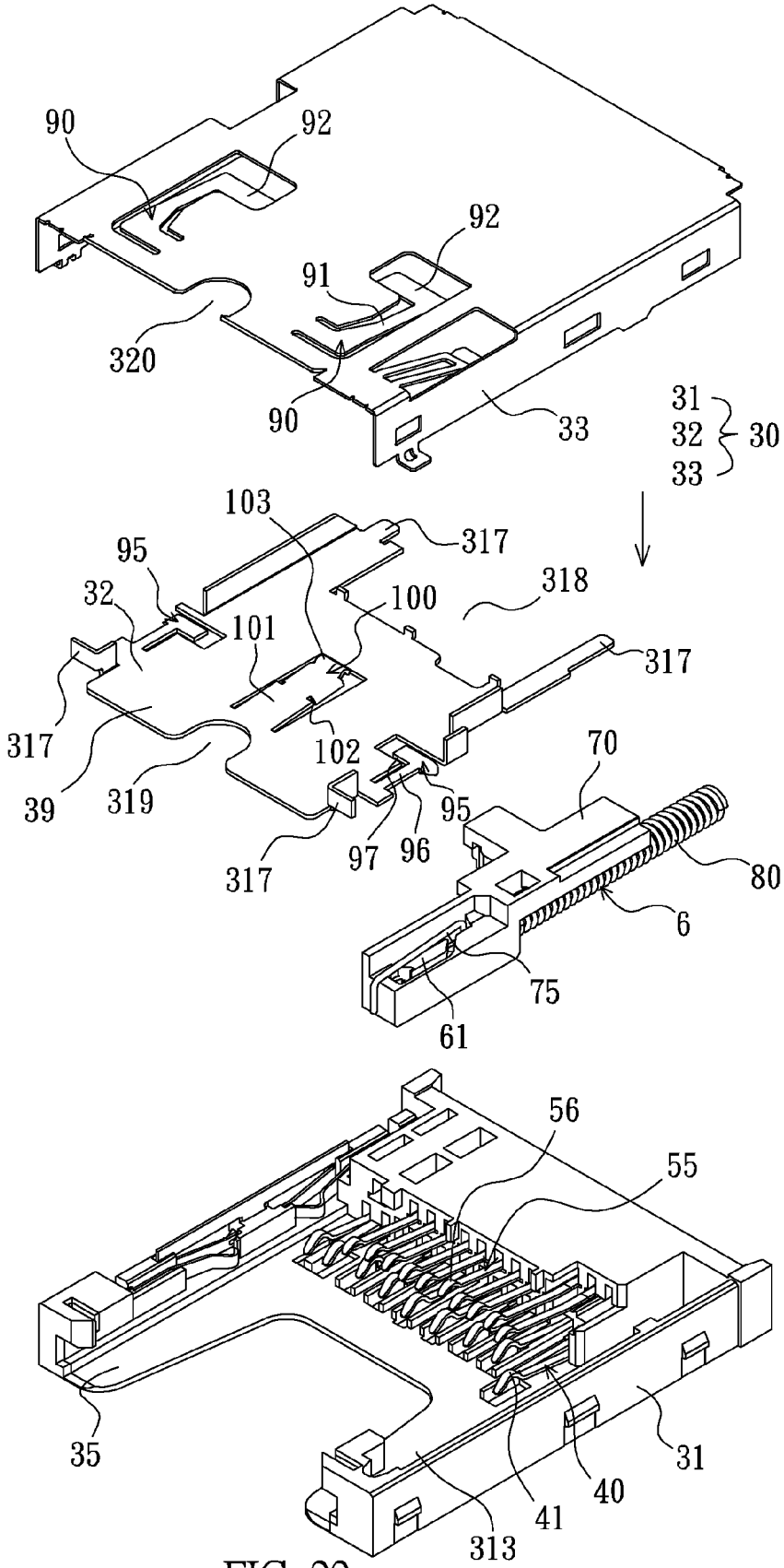
FIG. 22 is a pictorially exploded view showing a tenth embodiment of the invention.
Figure 23:
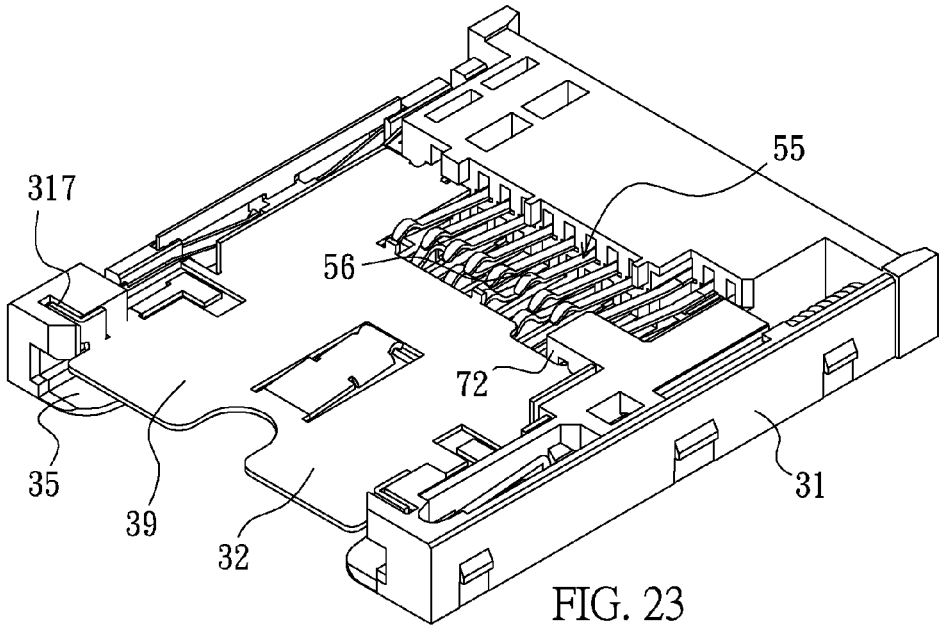
FIG. 23 is a pictorially assembled view showing the tenth embodiment of the invention without the upper cover.
Figure 24:
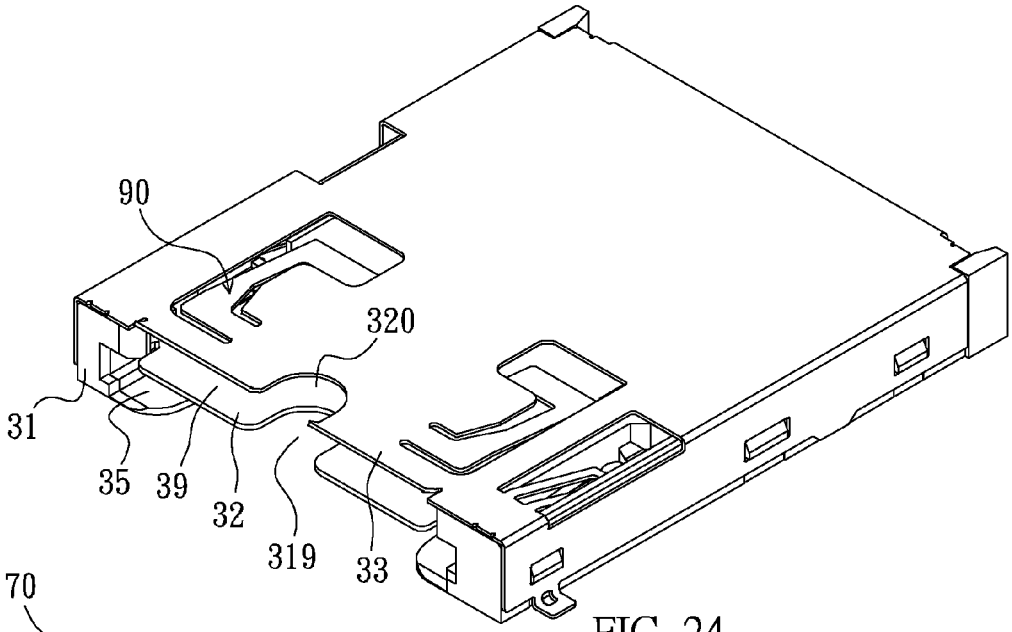
FIG. 24 is a pictorially assembled view showing the tenth embodiment of the invention.

As shown in FIGS. 22 to 24, the tenth embodiment of the invention is a connector shared by three memory cards, and is almost the same as the eighth embodiment. Similarly, one base 30 and an ejector 6 are provided. The difference resides in that the two stopper sheets 92 of the stopper structure 90 of this embodiment are separated and are disconnected from each other. The baffle 32 is a base formed by pressing and bending a metal sheet. The baffle 32 is formed with the upper slot 39, and four corners of the baffle 32 are respectively formed with four engaging sheet 317. In addition, the rear section of the baffle 32 is formed with a notch 318. The baffle 32 engages with the plastic base 31 through the engaging sheet 317, so that the base 30 is divided into the upper slot 39 and the lower slot 35. The baffle 32 defines the bottom surface of the upper slot 39 and the top surface of the lower slot 35. The contact 56 of the one row of first upper terminals 55 projects from the notch 318 to the upper slot 39. The front end of the baffle 32 is formed with a notch 319. The front end of the metal upper cover 33 is also formed with a notch 320 corresponding to the notch 319. Thus, when the mini-SDC is incorrectly inserted and falls into the base, the finger still can access the card through the notches.

In addition, two sides of the baffle 32 are respectively formed with two upper elastic stopping sheets 95. The upper elastic stopping sheet 95 has an elastic arm 96, a stopper 97 and a downward projection 98. One end of the elastic arm 96 is connected to the baffle 32 and extends backwards. The stopper 97 and the projection 98 are connected to the other end of the elastic arm 96. The projection 98 tilts downwards. The middle of the baffle 32 is formed with a lower elastic stopping sheet 100 projecting upwards. The lower elastic stopping sheet 100 has an elastic arm 101, a downward stopper 102 and an upward projection 103. The elastic arm 101 has one end connected to the baffle 32 and tilts backwards and extends projectingly. The stopper 102 and the projection 103 are disposed on the other end of the elastic arm 101. The projection 102 projects beyond the upper slot 39, and the stopper 102 is bent downwards.

Figure 25:
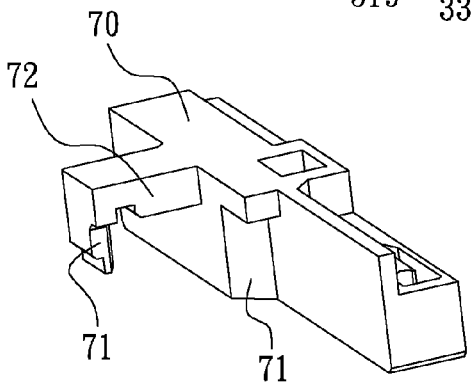
FIG. 25 is a pictorial view showing a sliding sheet according to the tenth embodiment of the invention.

As shown in FIG. 25, the sliding sheet 70 is disposed on the first pushing portion 71 of the lower slot 35 and includes a laterally inclined push surface and a transversal push surface of the front end, such that the SDC can push the surfaces more stably. The second pushing portion 72 of the sliding sheet 70 disposed in the upper slot 39 is a transversal push surface disposed above the first pushing portion 71.

Figure 26:
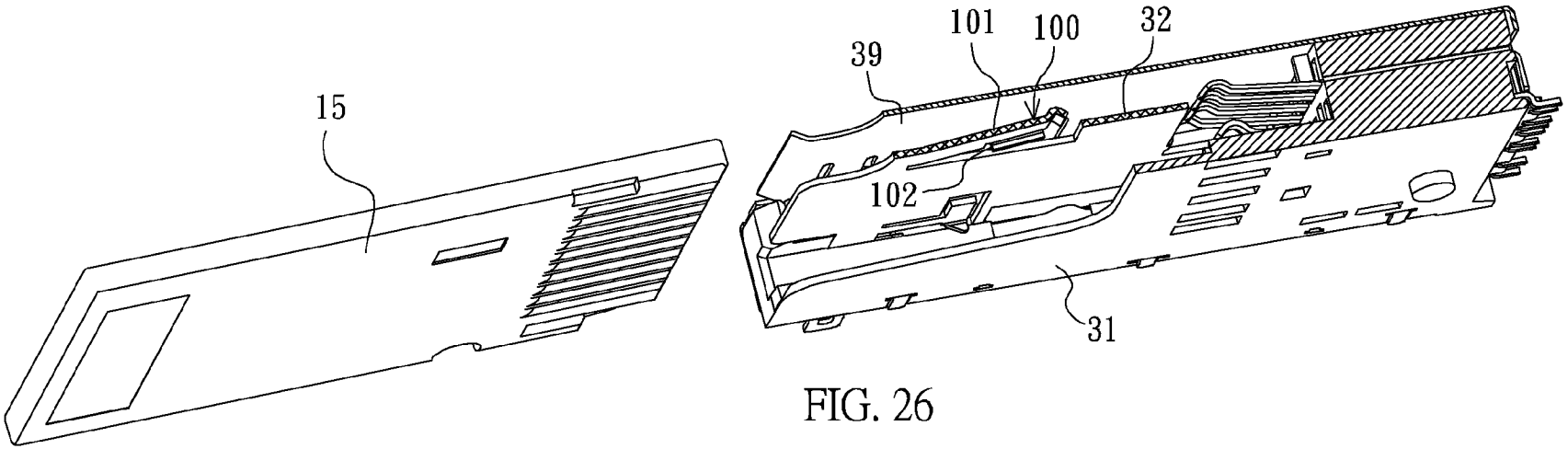
FIGS. 26 to 29 show the usage states according to the tenth embodiment of the invention.
Figure 27:
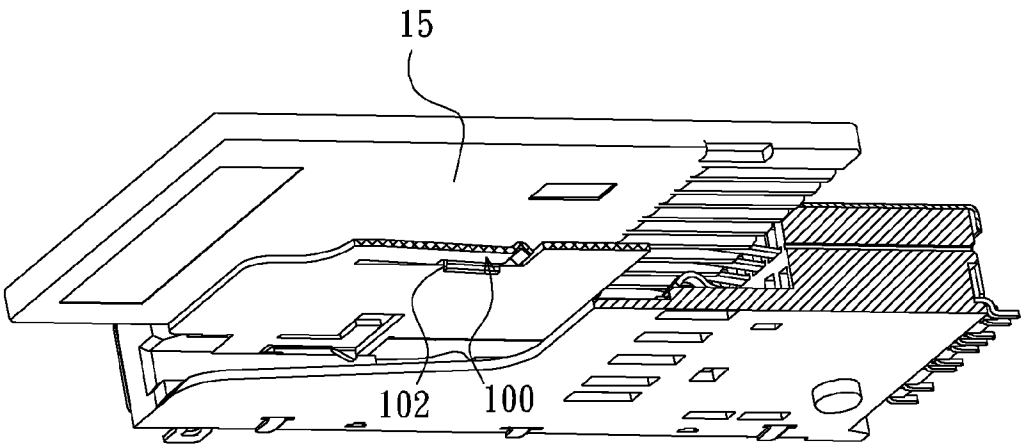

As shown in FIGS. 26 and 27, when the SDC 13 is inserted into the lower slot 35, it presses against the projections 98 of the two upper elastic stopping sheets 95 so that the upper elastic stopping sheet 95 projects toward the upper slot 39 and the stopper 97 projects beyond the upper slot 39. Thus, the other electrical card cannot be inserted into the upper slot.

Figure 28:
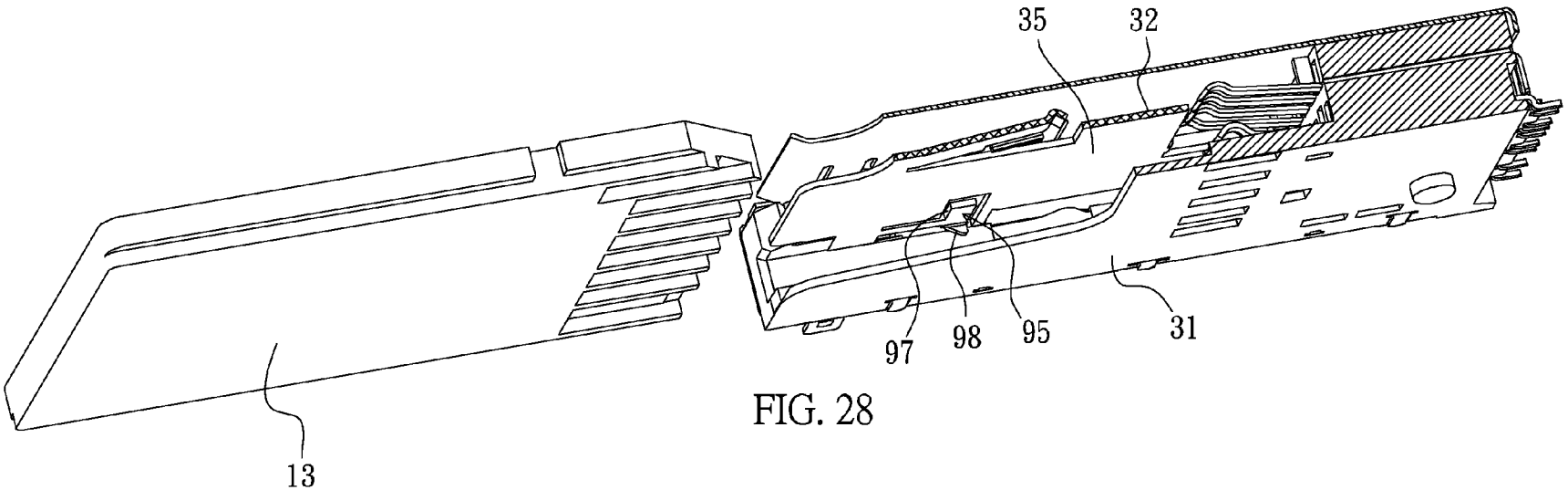
Figure 29:
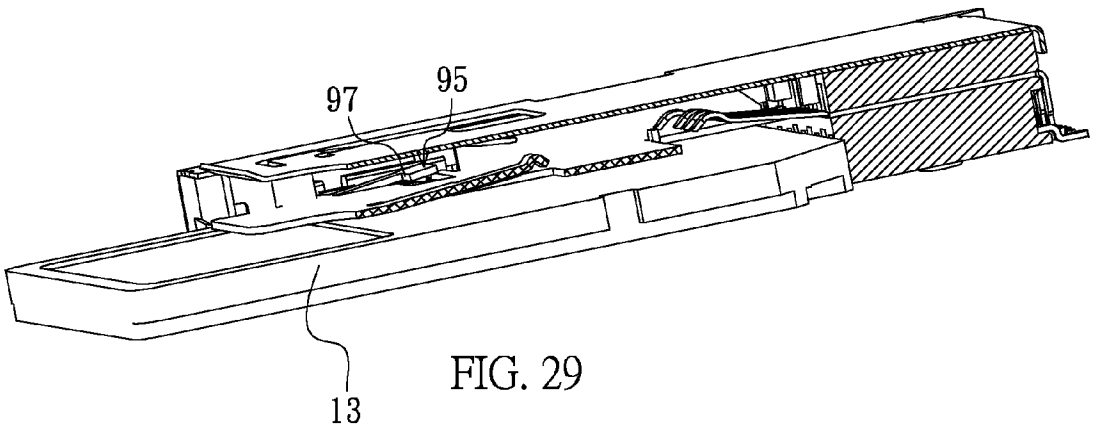

As shown in FIGS. 28 and 29, when the MS-Dou C 15 is inserted into the upper slot 39, it presses against the projection 103 of the lower elastic stopping sheet 100 so that the lower elastic stopping sheet 100 sinks into the lower slot 35 and the stopper 102 is disposed in the lower slot 35. Thus, the other electrical card cannot be inserted into the lower slot 35.

According to the above-mentioned descriptions, it is obtained that this embodiment can achieve the object that only one electrical card can be inserted into and electrically connected to one of the upper and lower slots at the same time, and that the two electrical cards cannot be simultaneously inserted into the slots for electrical connections.

Figure 30:
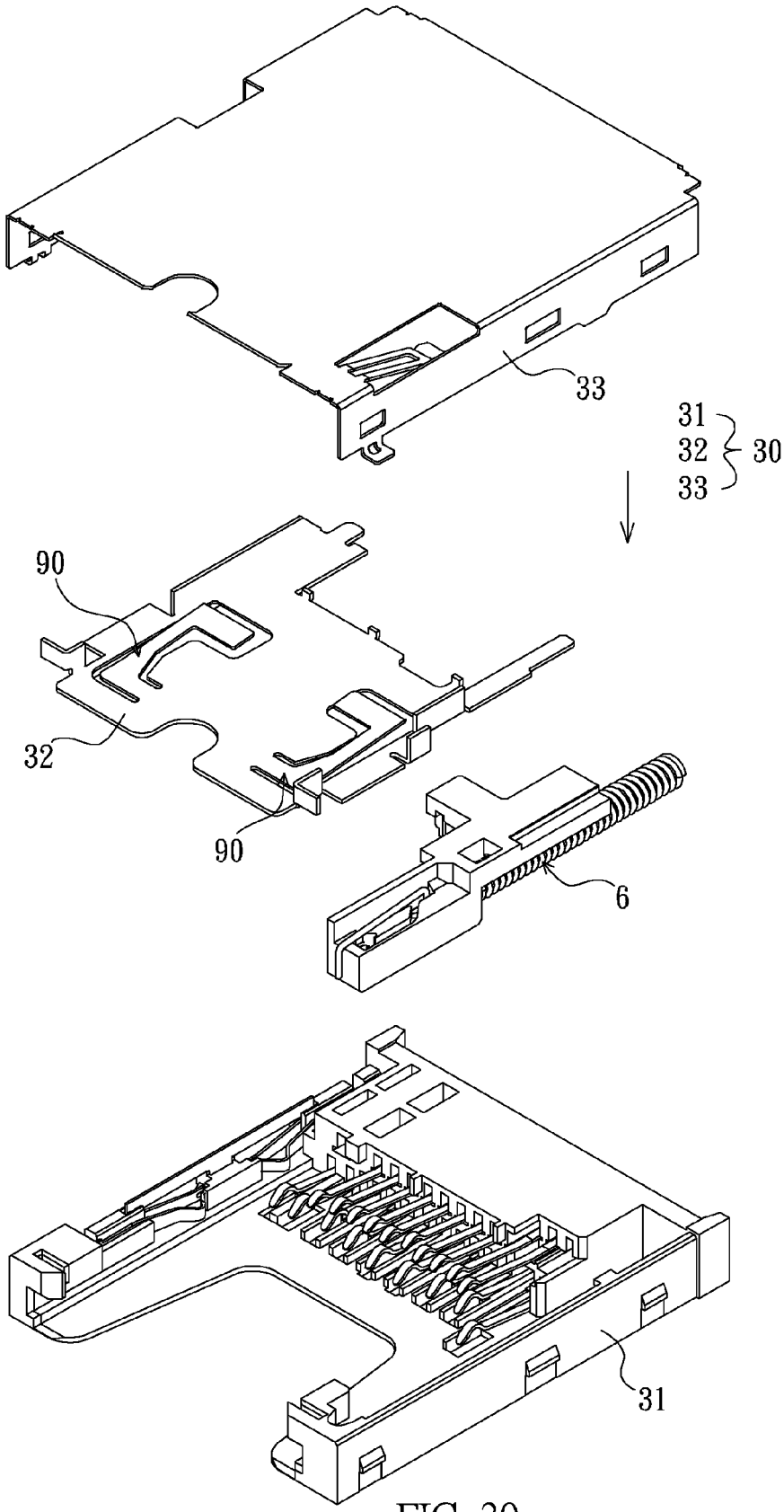
FIG. 30 is a pictorially exploded view showing an eleventh embodiment of the invention.

As shown in FIG. 30, the eleventh embodiment of the invention is almost the same as the tenth embodiment except that the stopper structure 90 of this embodiment is disposed on the baffle 32 and projects upwards. In addition, the baffle 32 does not have the upper elastic stopping sheet and the lower elastic stopping sheet.

Figure 31:
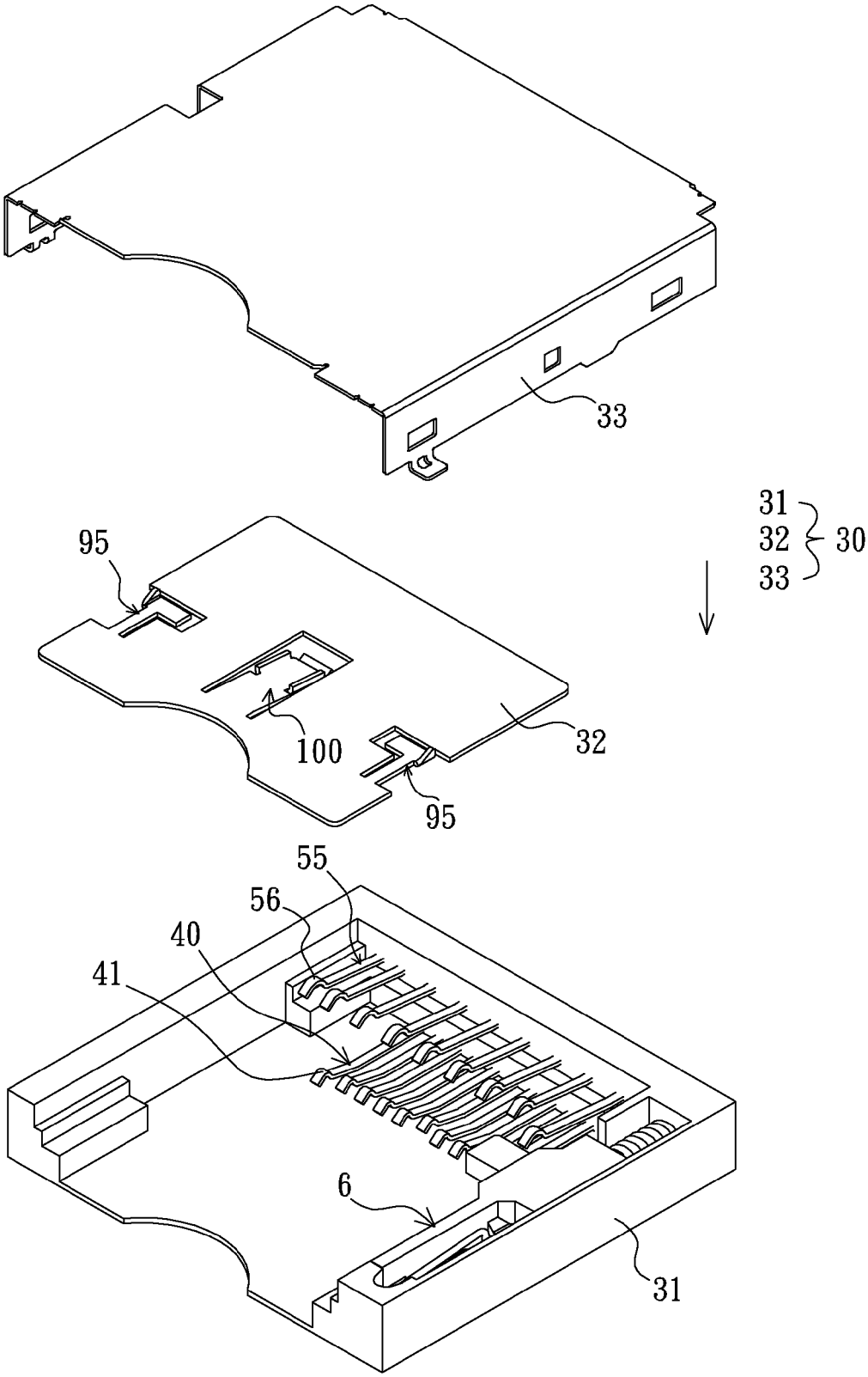
FIG. 31 is a pictorially exploded view showing a twelfth embodiment of the invention.
Figure 32:
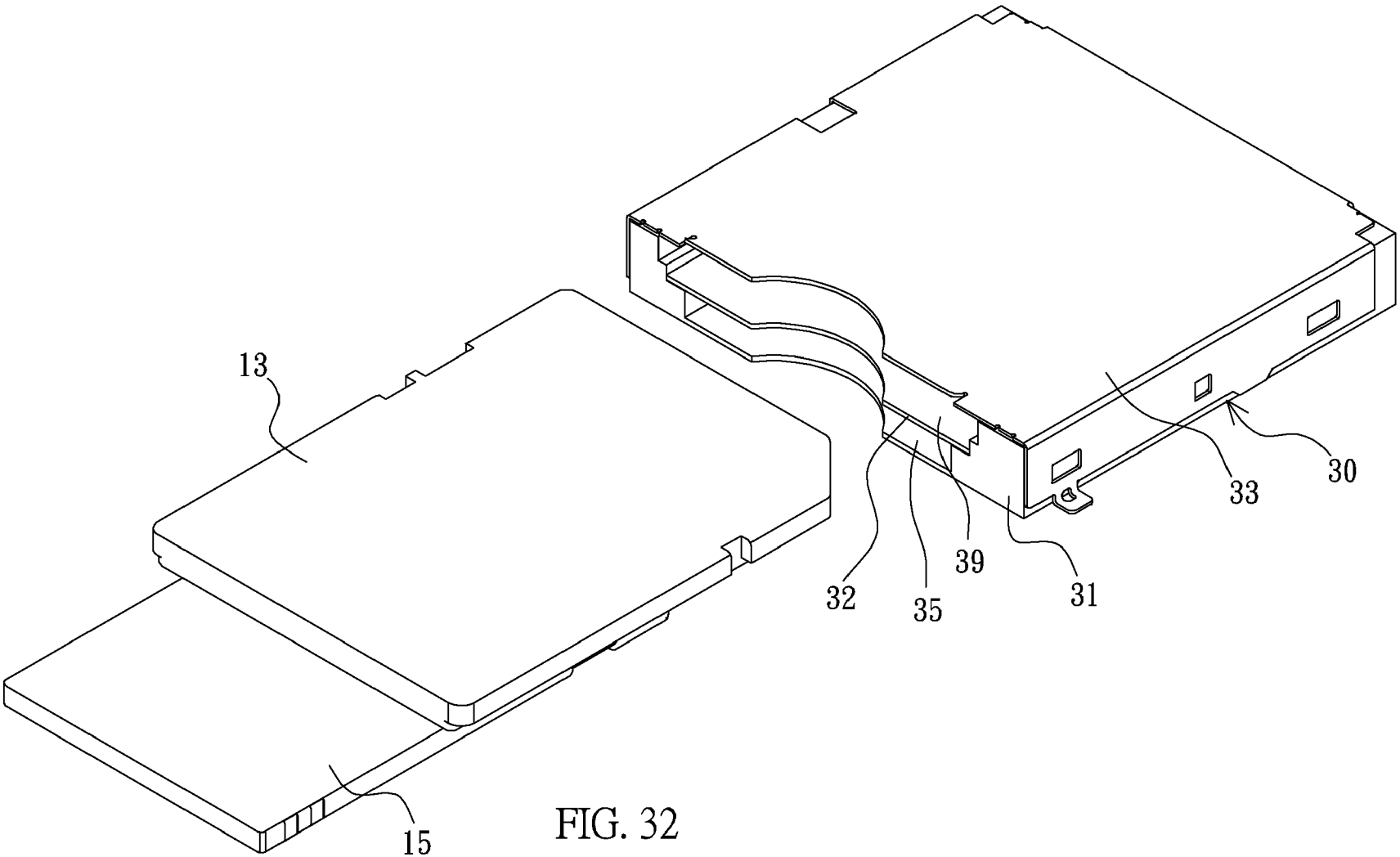
FIG. 32 shows the usage state of the twelfth embodiment of the invention.

As shown in FIGS. 31 and 32, the twelfth embodiment of the invention is almost the same as the tenth embodiment except that the upper slot 39 of this embodiment is for receiving an inserted SDC 13, which is to be electrically connected thereto, while the lower slot 35 is for receiving an inserted MS-Dou C 15, which is to be electrically connected thereto, wherein the baffle 32 engages with the plastic base 31.

Figure 33:
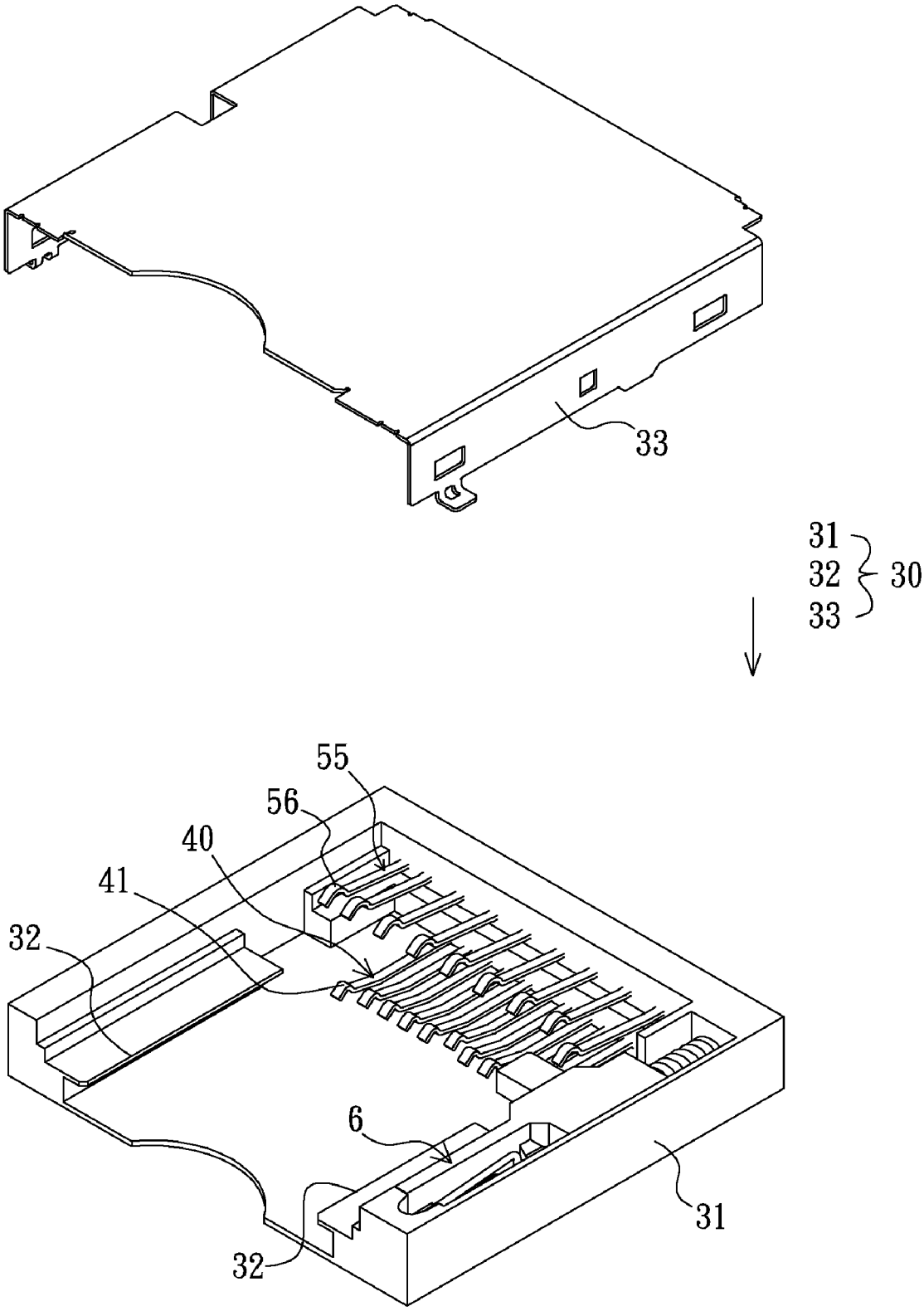
FIG. 33 is a pictorially exploded view showing a thirteenth embodiment of the invention.

As shown in FIG. 33, the thirteenth embodiment of the invention is almost the same as the twelfth embodiment except that the baffle 32 of this embodiment and the plastic base 31 are integrally formed, and that the baffle 32 is disposed on two plate surfaces on two inner sides of the plastic base 31.

While the invention has been described by way of examples and in terms of preferred embodiments, it is to be understood that the invention is not limited thereto. To the contrary, it is intended to cover various modifications. Therefore, the scope of the appended claims should be accorded the broadest interpretation so as to encompass all such modifications.

What is claimed is:

1. A multilayer electronic card connector, comprising:

a base, in which a baffle for separating the base into an upper slot and a lower slot is positioned, wherein the baffle defines a bottom surface of the upper slot and a top surface of the lower slot, the upper slot may accommodate at least one upper electrical card, the lower slot and may accommodate at least one lower electrical card;

at least one row of upper terminals disposed in the base, wherein each of the upper terminals has a contact disposed in the upper slot;

at least one row of lower terminals disposed in the base, wherein each of the lower terminals has a contact disposed in the lower slot; and an ejector disposed in the base, wherein the ejector comprises:

a core having a sliding slot defining a circulation path, wherein one end of the sliding slot has a concave positioning point, the other end of the sliding slot has a starting point, such that unidirectional circulation successively from the starting point to the positioning point and then to the starting point is formed;

a sliding sheet, which may slide back and forth relatively to the base, wherein the sliding sheet has a first pushing portion and a second pushing portion, the first pushing portion is disposed in the lower slot, and the second pushing portion is disposed in the upper slot;

a guiding rod having one end engaged into the sliding slot of the core and being slidable along the circulation path; and an elastic member for providing elasticity for moving the sliding sheet into the base and then returning the sliding sheet to a home position, wherein:

when the lower electrical card is inserted into the lower slot, the lower electrical card can rest against the first pushing portion to push the sliding sheet to slide relatively to the base; and when the upper electrical card is inserted into the upper slot, the upper electrical card can rest against the second pushing portion to push the sliding sheet to slide relatively to the base.

2. The connector according to claim 1, wherein the one row of upper terminals are electrically connected to the one row of lower terminals in a one-to-one manner.

3. The connector according to claim 1, wherein the base has a plastic base, the baffle and a metal upper cover, the baffle is positioned in the plastic base, and the metal upper cover covers over the plastic base.

4. The connector according to claim 3, wherein the baffle and the plastic base are integrally connected together.

5. The connector according to claim 3, wherein the baffle and the plastic base are two separate members engaging with each other.

6. The connector according to claim 1, wherein there are multiple rows of the upper terminals, the upper slot may accommodate multiple upper electrical cards with different interfaces or different shapes, there are multiple rows of the lower terminals, and the lower slot may accommodate multiple lower electrical cards with different interfaces or different shapes.

7. The connector according to claim 6, wherein there are four rows of the lower terminals disposed on the base, five memory cards including SDC, XDC, MSC, MMC and MMC-plus can be inserted into the lower slot, and the five memory cards may be respectively electrically connected to the four rows of lower terminals.

8. The connector according to claim 6, wherein there are two rows of the upper terminals disposed on the baffle, and an MSHG C and an MS-Dou C may be inserted into the upper slot and be electrically connected to the two rows of upper terminals.

9. The connector according to claim 1, wherein the two electrical cards may be respectively inserted into and electrically connected to the upper and lower slots.

10. The connector according to claim 1, wherein an MS-Dou C may be inserted into and electrically connected to the upper slot, and an SDC may be inserted into and electrically connected to the lower slot.

11. The connector according to claim 1, wherein a stopper structure is further disposed in the base, the stopper structure has at least one elastic arm and at least one stopper sheet, the elastic arm is disposed on one side of the upper slot and tilts and extends in a front-to-rear direction, the stopper sheet is connected to a rear end of the elastic arm and extends transversally inwards, when the upper electrical card is inserted from the upper slot and one side of the upper electrical card does not press the elastic arm of the stopper structure, the upper electrical card, which is further inserted, rests against a front edge of the stopper sheet.

12. The connector according to claim 11, wherein the stopper structure has two elastic arms and two stopper sheets, and the two elastic arms are disposed on two sides of the upper slot.

13. The connector according to claim 12, wherein the two stopper sheets are connected together through a transversal strip such that the stopper structure has an inverse-U shape.

14. The connector according to claim 11, wherein the base further has a metal upper cover, the stopper structure projects downwardly from the metal upper cover, and one end of the elastic arm is connected to the metal upper cover.

15. The connector according to claim 11, wherein the baffle is a metal sheet, the stopper structure projects upwardly from the baffle, and the elastic arm has one end connected to the baffle.

16. The connector according to claim 1, wherein the baffle is a metal sheet.

17. The connector according to claim 16, wherein the baffle has at least one upper elastic stopping sheet, the upper elastic stopping sheet has an elastic arm, a stopper and a downward projection, and when the lower electrical card is inserted into the lower slot to press against the projection, the upper elastic stopping sheet projects towards the upper slot to make the stopper be disposed in the upper slot and to prevent the upper electrical card from being inserted into the upper slot.

18. The connector according to claim 16, wherein the baffle has at least one lower elastic stopping sheet, the lower elastic stopping sheet has an elastic arm, a projection and a downward stopper, the projection projects beyond the upper slot, and when the upper electrical card is inserted into the upper slot to press against the projection, the lower elastic stopping sheet is forced downwards such that the stopper is disposed in the lower slot to prevent the lower electrical card from being inserted into the lower slot.

19. The connector according to claim 3, wherein a front end of the baffle is formed with a notch, and a front end of the metal upper cover is also formed with a notch corresponding to the notch of the baffle.

* * * * *